US009353537B2

(12) United States Patent
Wensel

(10) Patent No.: US 9,353,537 B2
(45) Date of Patent: May 31, 2016

(54) APPARATUS, SYSTEM AND METHOD FOR LIFTING A BUILDING

(71) Applicant: Monty Wensel, Regina (CA)

(72) Inventor: Monty Wensel, Regina (CA)

( * ) Notice: Subject to any disclaimer, the term of this patent is extended or adjusted under 35 U.S.C. 154(b) by 469 days.

(21) Appl. No.: 13/899,201

(22) Filed: May 21, 2013

(65) Prior Publication Data

US 2014/0346421 A1 Nov. 27, 2014

(51) Int. Cl.

| | |
|---|---|
| ***B66F 7/12*** | (2006.01) |
| ***E04G 23/06*** | (2006.01) |
| ***B66F 1/06*** | (2006.01) |
| ***B66F 3/46*** | (2006.01) |
| ***E04G 21/16*** | (2006.01) |

(52) U.S. Cl.

CPC ..... *E04G 23/065* (2013.01); *B66F 1/06* (2013.01); *B66F 3/46* (2013.01); *E04G 21/163* (2013.01)

(58) Field of Classification Search

USPC ..... 81/89 H, 89 R, 106, 108

See application file for complete search history.

(56) References Cited

U.S. PATENT DOCUMENTS 3,273,859 A * 9/1966 Ernst ..... E02B 17/0854 254/109

3,881,687 A * 5/1975 Johansson ..... E02B 17/0863 254/1

5,980,160 A * 11/1999 Vanderklaauw ..... B66F 1/00 182/178.1

OTHER PUBLICATIONS

Notification of Transmittal of the International Search Report and the Written Opinion of the International Searching Authority, or the Declaration for PCT International Application No. PCT/CA2014/000441 dated Aug. 12, 2014.

* cited by examiner

*Primary Examiner* — Joseph J Hail

*Assistant Examiner* — Shantese McDonald

(74) *Attorney, Agent, or Firm* — Olive Law Group, PLLC

(57) ABSTRACT

An apparatus, system and method for raising and lowering a building, wherein a yoke receives the end of a building lifting beam and travels vertically on a vertical guide. The yoke is connected to a jack, and the yoke and jack are provided with independently releasable locking means. In operation, the jack is locked on the guide at an initial supporting position to allow the yoke to move, and then the yoke is locked on the guide to allow the jack to move to a new supporting position on the guide, allowing the yoke to climb up and down the guide through alternating component lockings and movements.

31 Claims, 46 Drawing Sheets

APPARATUS, SYSTEM AND METHOD FOR LIFTING A BUILDING

FIELD OF THE INVENTION

The present invention relates to means and methods for raising and lowering buildings.

BACKGROUND OF THE INVENTION

In various situations it may become desirable to raise an established building off of its foundations, for example to repair or replace those foundations or to relocate the building. Common practice is to elevate the building using jacking mechanisms and position increasing stacks of supporting blocks under strategically determined points on the building underside. It is also known to use beams to support the building as it is being lifted off of its foundations, and the beams are commonly raised by means of jacks, with supporting blocks being positioned under the beams as they are elevated to increased heights in an attempt to prevent a long fall should one or more of the jacks fail.

However, it has been found that traditional building lifting methods are time-consuming and require significant personnel to operate. In addition, the physical stability of the traditional systems may be inadequate and introduce unnecessary danger and risk of injury for those on site, particularly as heights increase. Various improvements have been proposed in the art, such as that presented in Canadian Patent Application No. 2,618,521 to the inventor of the present invention, wherein a support frame or yolk for the lifting beam is moved up and down a vertical guide structure using jacks, and stops can be provided as the yolk moves upwardly to prevent the risk of damage and injury from a long drop if the jack fails. However, it has been determined that a need for further improvement is desired.

SUMMARY OF THE INVENTION

According to a first aspect of the present invention, then, there is provided an apparatus for raising and lowering an end of a building lifting beam, the apparatus comprising:

a vertically oriented guide member;

a yolk member configured to be received on the guide member for vertical movement thereon, the yolk member configured to receive the end of the building lifting beam;

at least one selectively extendable and retractable jack on the yolk member for raising or lowering the yoke member to a desired yoke position on the guide member;

first locking means for releasably locking the yolk member in the desired yoke position on the guide member; and second locking means for releasably locking the at least one jack in a desired jack support position on the guide member;

such that when the first locking means are engaged and the second locking means are disengaged, the at least one jack can be moved to the desired jack support position; and when the first locking means are disengaged and the second locking means are engaged, the at least one jack can move the yoke member and the end of the building lifting beam to the desired yoke position.

In some exemplary embodiments of the first aspect, the apparatus may comprise power means for powering extension and retraction of the at least one jack. The first locking means may comprise a releasable pin capable of receipt in a hole in the yoke member and a corresponding hole in the guide member when the holes are aligned, and the second locking means may comprise a releasable pin capable of receipt in a hole in the guide member for supporting the jack, the guide member being provided with a plurality of holes for locking of the yoke member or jack at various vertically spaced positions on the guide member. The apparatus may then further comprise hole position sensing means, and the releasable pin may be configured to be automatically received in the hole upon the hole position sensing means sensing that a desired hole position has been reached. The apparatus may further comprise automatic shut-off means for the power means, the automatic shut-off means preferably comprising hole position sensing means for sensing that a desired hole position has been reached at which jack extension or retraction is to terminate. The guide member is preferably of modular construction to enable disassembly for ease of storage and transport, and the apparatus may further comprise at least one vertical extension configured for receipt on top of the guide member, each of the at least one vertical extensions configured for receipt of the yolk member.

According to a second aspect of the present invention, there is provided a system for raising and lowering a building, the system comprising:

a first pair of spaced apart vertically oriented guide members, each of the guide members for disposition on opposite sides of the building;

a second pair of spaced apart vertically oriented guide members, each of the guide members for disposition on opposite sides of the building;

a yolk member on each of the guide members, the yolk member configured for vertical movement thereon;

a first building lifting beam having opposed ends configured for receipt by the yolk members of the first pair of spaced apart vertically oriented guide members, the first building lifting beam configured for positioning beneath the building;

a second building lifting beam having opposed ends configured for receipt in the yolk members of the second pair of spaced apart vertically oriented guide members, the second building lifting beam configured for positioning beneath the building;

at least one selectively extendable and retractable jack on each yolk member for raising or lowering the yoke member to a desired yoke position on the guide member;

first locking means for releasably locking each yolk member in the desired yoke position on the guide member; and second locking means for releasably locking each jack in a desired jack support position on the guide member;

such that when the first locking means for each yolk member are engaged and the second locking means for each jack are disengaged, each jack can be moved to the desired jack support position; and when the first locking means for each yolk member are disengaged and the second locking means for each jack are engaged, each jack can move the yoke member and the end of the building lifting beam to the desired yoke position.

In some exemplary embodiments of the second aspect, the building lifting beams are of modular construction, the system further comprising detachable primary beam sections for extending the length of the building lifting beams.

According to a third aspect of the present invention, there is provided a system for raising and lowering a building, the system comprising:

a first pair of spaced apart vertically oriented guide members;

a second pair of spaced apart vertically oriented guide members, the second pair of spaced apart vertically oriented guide members for disposition on an opposite side of the building from the first pair of spaced apart vertically oriented guide members;

a yolk member on each of the guide members, the yolk member configured for vertical movement thereon;

at least two primary lifting beams configured for positioning beneath the building, each of the primary lifting beams having opposed first and second ends;

a first secondary lifting beam having opposed ends configured for receipt by the yolk members of the first pair of spaced apart vertically oriented guide members, the first ends of the at least two primary lifting beams configured for connection to the first secondary lifting beam;

a second secondary lifting beam having opposed ends configured for receipt by the yolk members of the second pair of spaced apart vertically oriented guide members, the second ends of the at least two primary lifting beams configured for connection to the second secondary lifting beam;

at least one selectively extendable and retractable jack on each yolk member for raising or lowering the yoke member to a desired yoke position on the guide member;

first locking means for releasably locking each yolk member in the desired yoke position on the guide member; and second locking means for releasably locking each jack in a desired jack support position on the guide member;

such that when the first locking means for each yolk member are engaged and the second locking means for each jack are disengaged, each jack can be moved to the desired jack support position; and when the first locking means for each yolk member are disengaged and the second locking means for each jack are engaged, each jack can move the yoke member and the secondary lifting beam to the desired yoke position, thereby moving the primary lifting beam to raise or lower the building.

According to a fourth aspect of the present invention, there is provided a method for raising a building, the method comprising the steps of:

a. providing at least two lifting beams and positioning them under the building;
b. providing a vertically oriented guide member for each end of each of the at least two lifting beams, each guide member comprising: a yolk member configured to be received on the guide member for vertical movement thereon, each yolk member comprising at least one selectively extendable and retractable jack; first locking means for releasably locking the yolk member in a position on the guide member; and second locking means for releasably locking the at least one jack in a position on the guide member;
c. receiving the ends of the lifting beams in the yoke members;
d. extending the jacks to force the yolk members upwardly, thereby raising the ends of the lifting beams;
e. engaging the first locking means;
f. retracting the jacks to raise the jacks;
g. engaging the second locking means to lock the jacks;
h. disengaging the first locking means; and
i. extending the jacks to force the yolk members upwardly, thereby raising the ends of the lifting beams.

In exemplary embodiments of the fourth aspect, the method preferably further comprises repeating steps e through i until the ends of the lifting beams are at a desired height relative to the guide members.

According to a fifth aspect of the present invention, there is provided a method for raising and lowering a building, the method comprising the steps of:

a. providing at least two lifting beams and positioning them under the building;
b. providing a vertically oriented guide member for each end of each of the at least two lifting beams, each guide member comprising: a yolk member configured to be received on the guide member for vertical movement thereon, each yolk member comprising at least one selectively extendable and retractable jack; first locking means for releasably locking the yolk member in a position on the guide member; and second locking means for releasably locking the at least one jack in a position on the guide member;
c. receiving the ends of the lifting beams in the yoke members;
d. extending the jacks to force the yolk members upwardly, thereby raising the ends of the lifting beams;
e. engaging the first locking means;
f. retracting the jacks to raise the jacks;
g. engaging the second locking means to lock the jacks;
h. disengaging the first locking means;
i. extending the jacks to force the yolk members upwardly, thereby raising the ends of the lifting beams;
j. repeating steps e through i until the ends of the lifting beams are at an upper desired height relative to the guide members;
k. maintaining the ends of the lifting beams at the upper desired height for a desired period;
l. retracting the jacks to lower the yolk members, thereby lowering the ends of the lifting beams;
m. engaging the first locking means;
n. disengaging the second locking means;
o. extending the jacks to lower the jacks;
p. engaging the second locking means;
q. disengaging the first locking means;
r. retracting the jacks to lower the yolk members, thereby lowering the ends of the lifting beams; and
s. repeating steps m through r until the ends of the lifting beams are at a lower desired height relative to the guide members.

A detailed description of an exemplary embodiment of the present invention is given in the following. It is to be understood, however, that the invention is not to be construed as being limited to this embodiment.

BRIEF DESCRIPTION OF THE DRAWINGS

In the accompanying drawings, which illustrate an exemplary embodiment of the present invention.

An exemplary embodiment of the present invention will now be described with reference to the accompanying drawings.

DETAILED DESCRIPTION OF EXEMPLARY EMBODIMENT

Figure 1A:
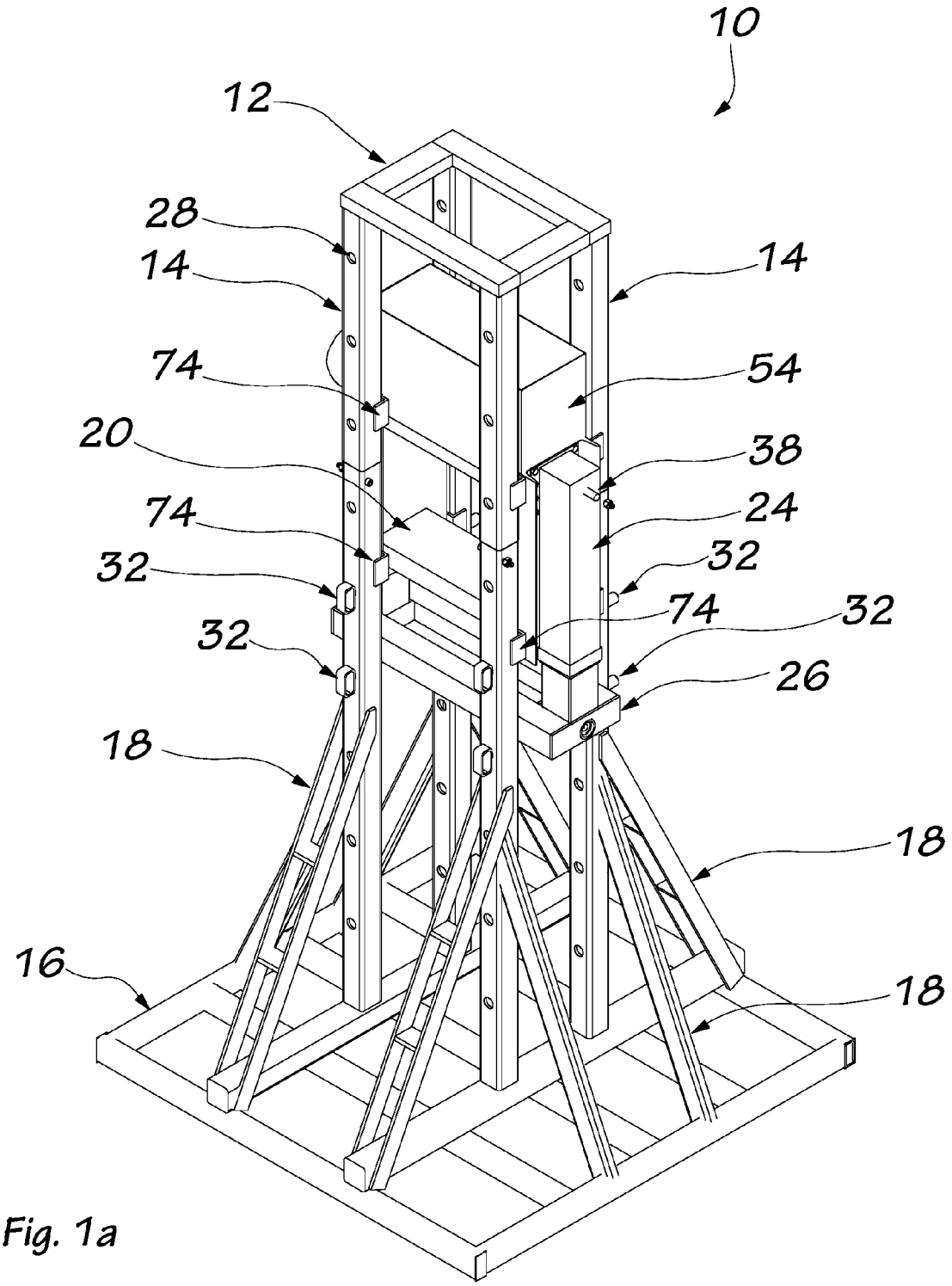
FIG. 1*a* is left rear perspective view of a guide tower according to the present invention.
Figure 1B:
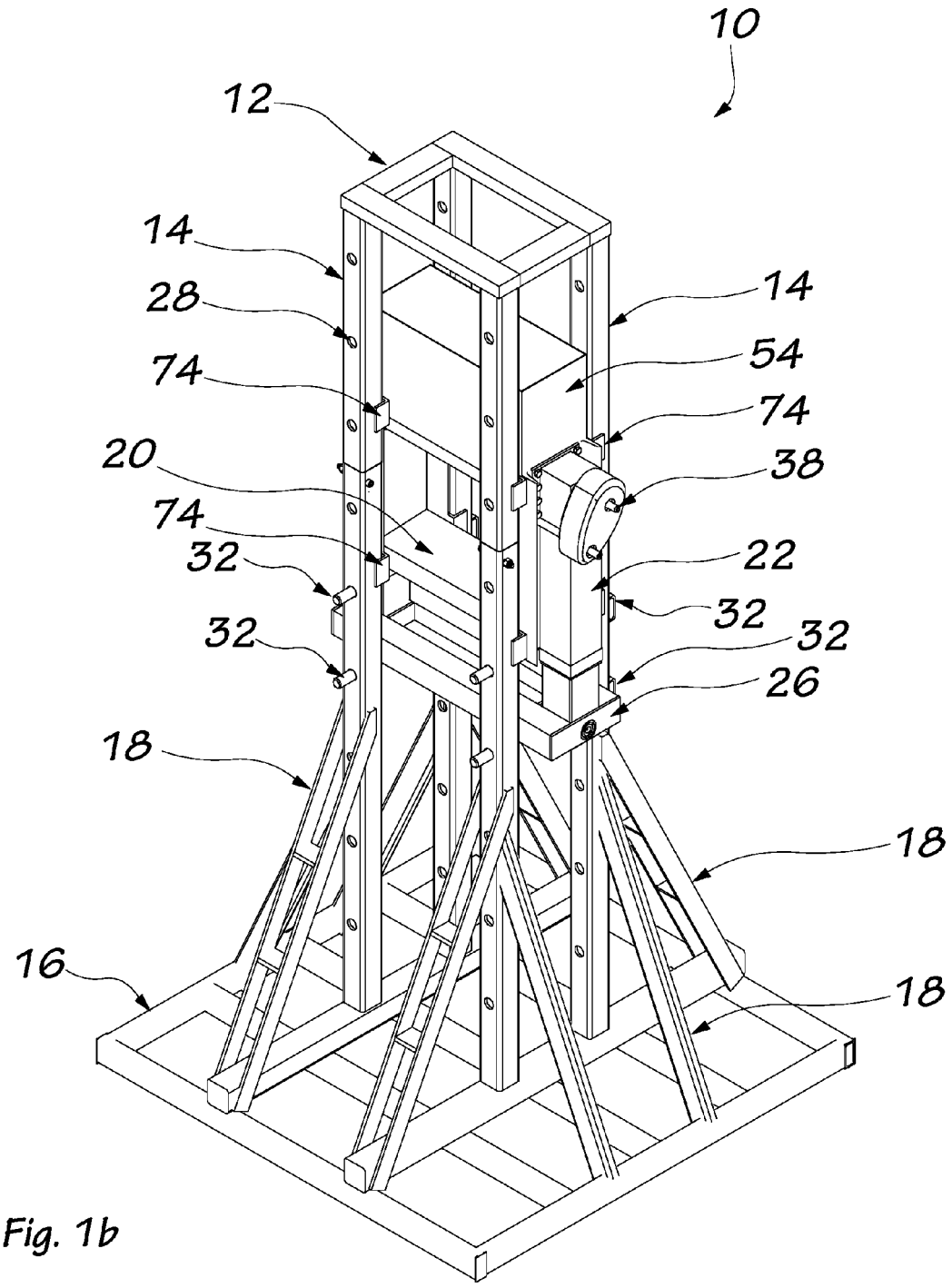
FIG. 1*b* is a right front perspective view of the guide tower of FIG. 1*a;*
Figure 2A:
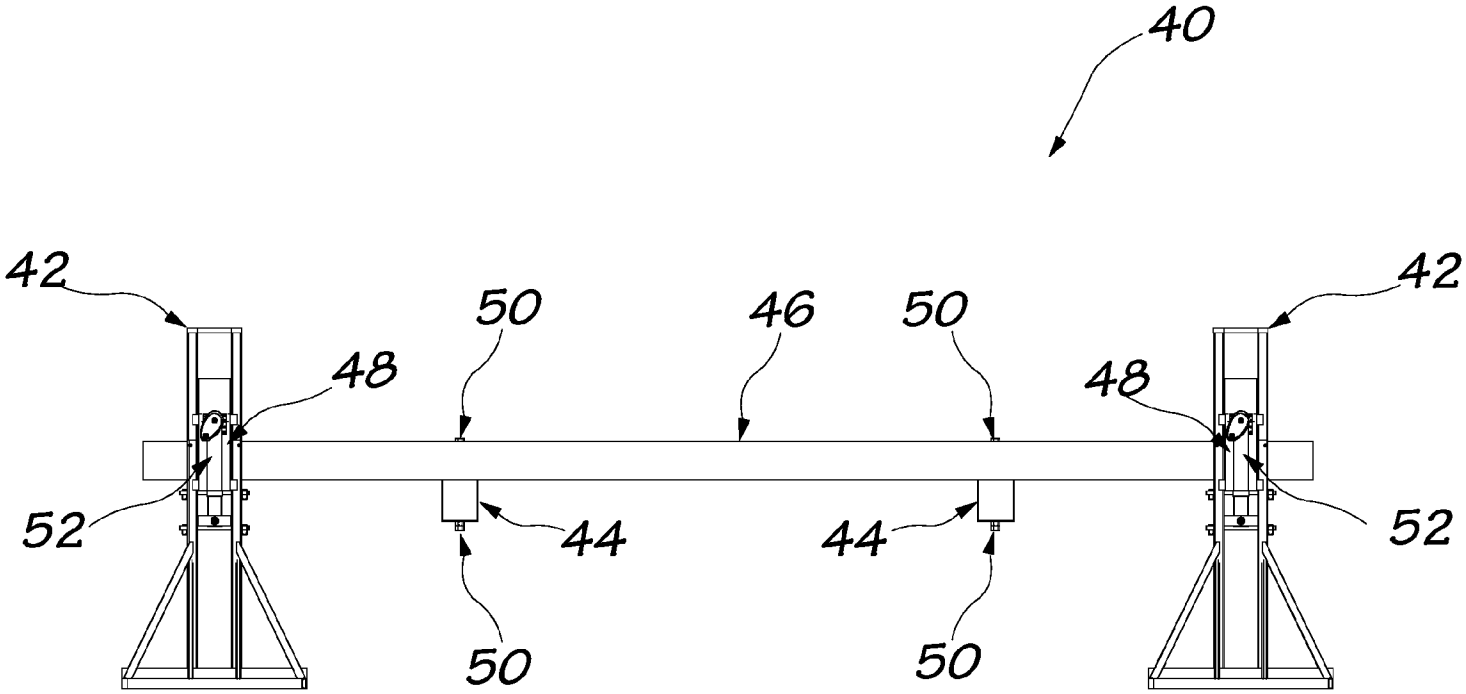
FIG. 2*a* is a left side elevation view of a system according to the present invention.
Figure 2B:
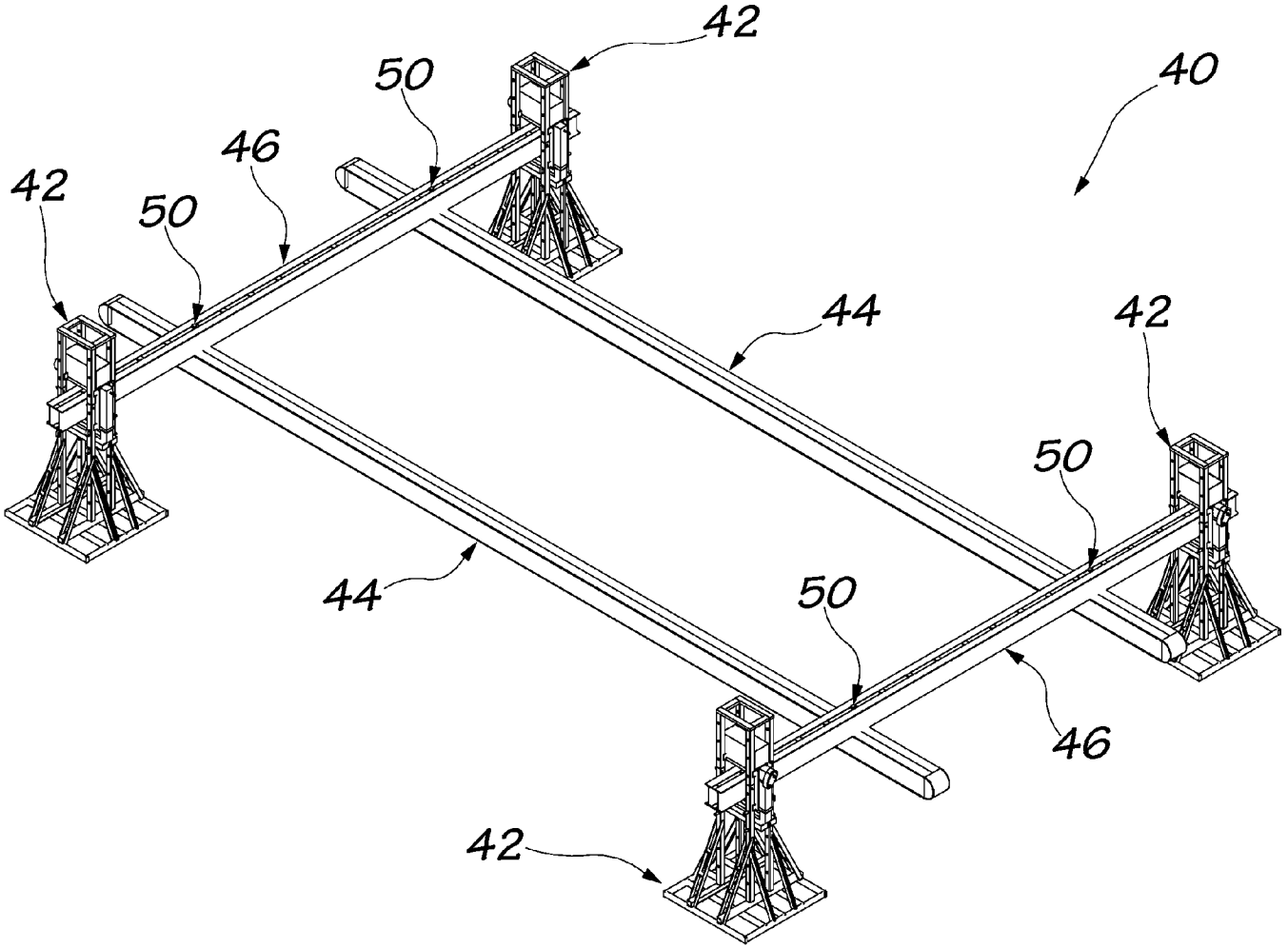
FIG. 2*b* is a perspective view of the system of FIG. 2*a;*
Figure 2C:
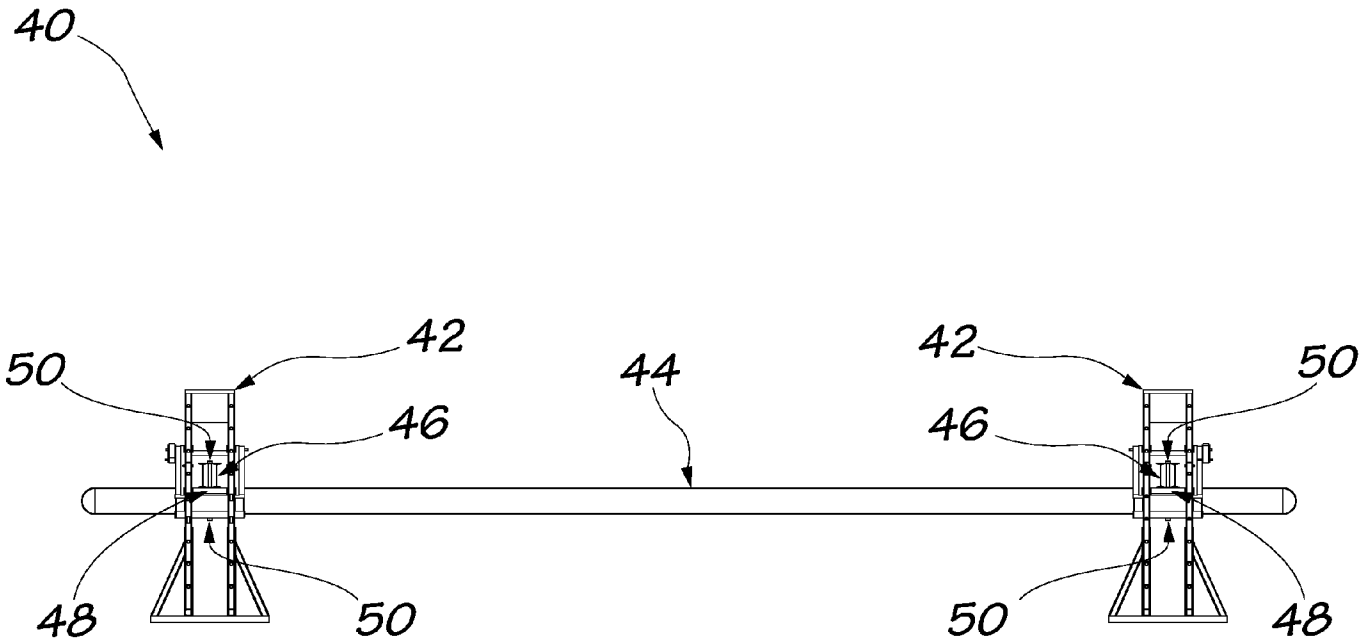
FIG. 2*c* is a front elevation view of the system of FIG. 2*a;*
Figure 2D:
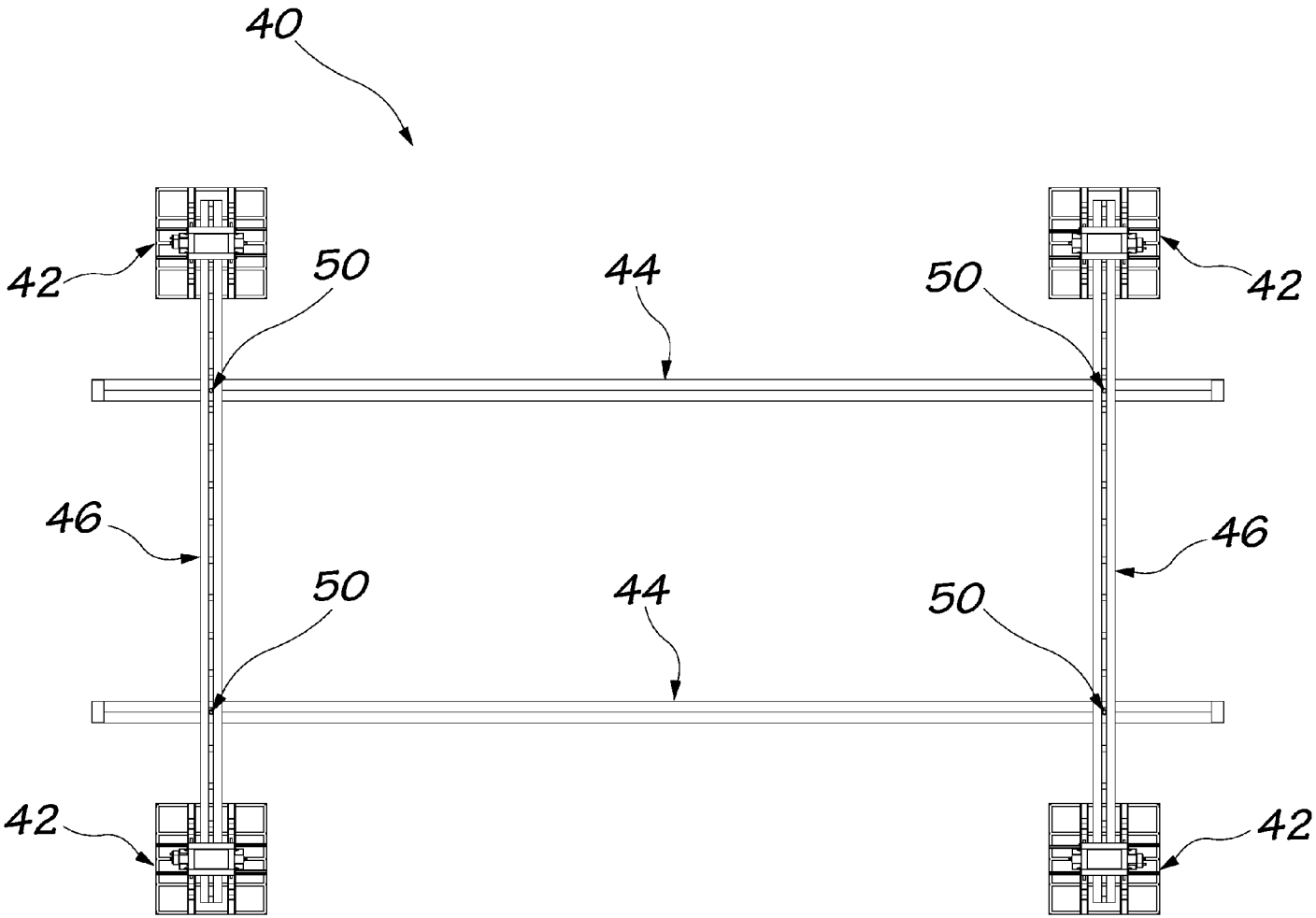
FIG. 2*d* is a top plan view of the system of FIG. 2*a;*

Turning now to FIGS. 1*a* and 1*b*, an exemplary apparatus or tower according to the present invention is illustrated and is designated by the reference numeral 10. The tower 10 is used in exemplary methods and systems to support an end of a building lifting beam and move the end up and down as desired to raise or lower a supported building. The tower 10 comprises a vertical guide 12 and a base 16, with angled supports 18 configured to provide structural support to the guide 12. The guide 12 itself comprises four vertical masts 14 which serve to receive and guide a yolk 20, the yolk 20 slidably engaged with the masts 14 by means of brackets 74. The masts 14 extend upwardly to horizontally disposed top braces, but it is within the scope of the present invention to add additional vertical extensions on top of the masts 14 if additional height is required in a particular application.

Figure 4A:
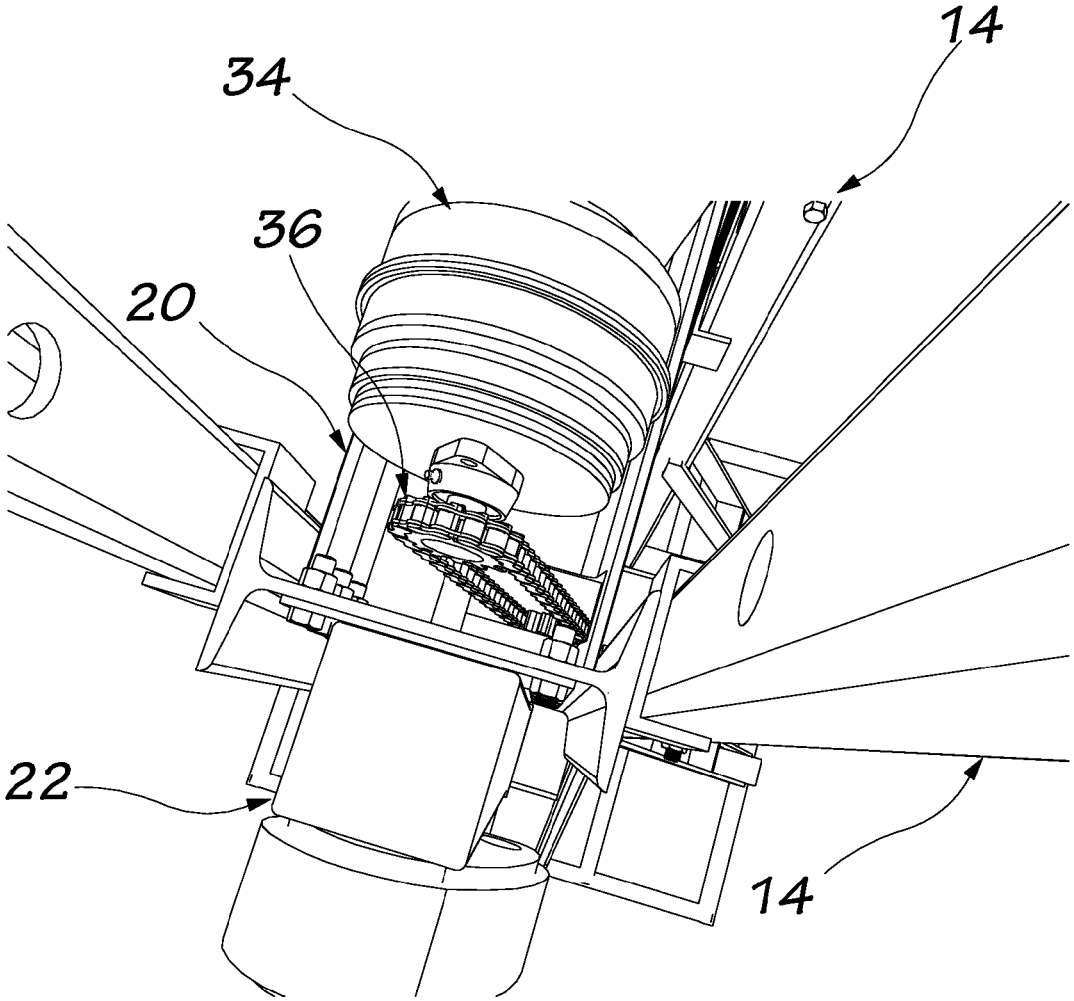
FIGS. 4*a* through 4*e* are detailed views of a chain drive according to the present invention.
Figure 4B:
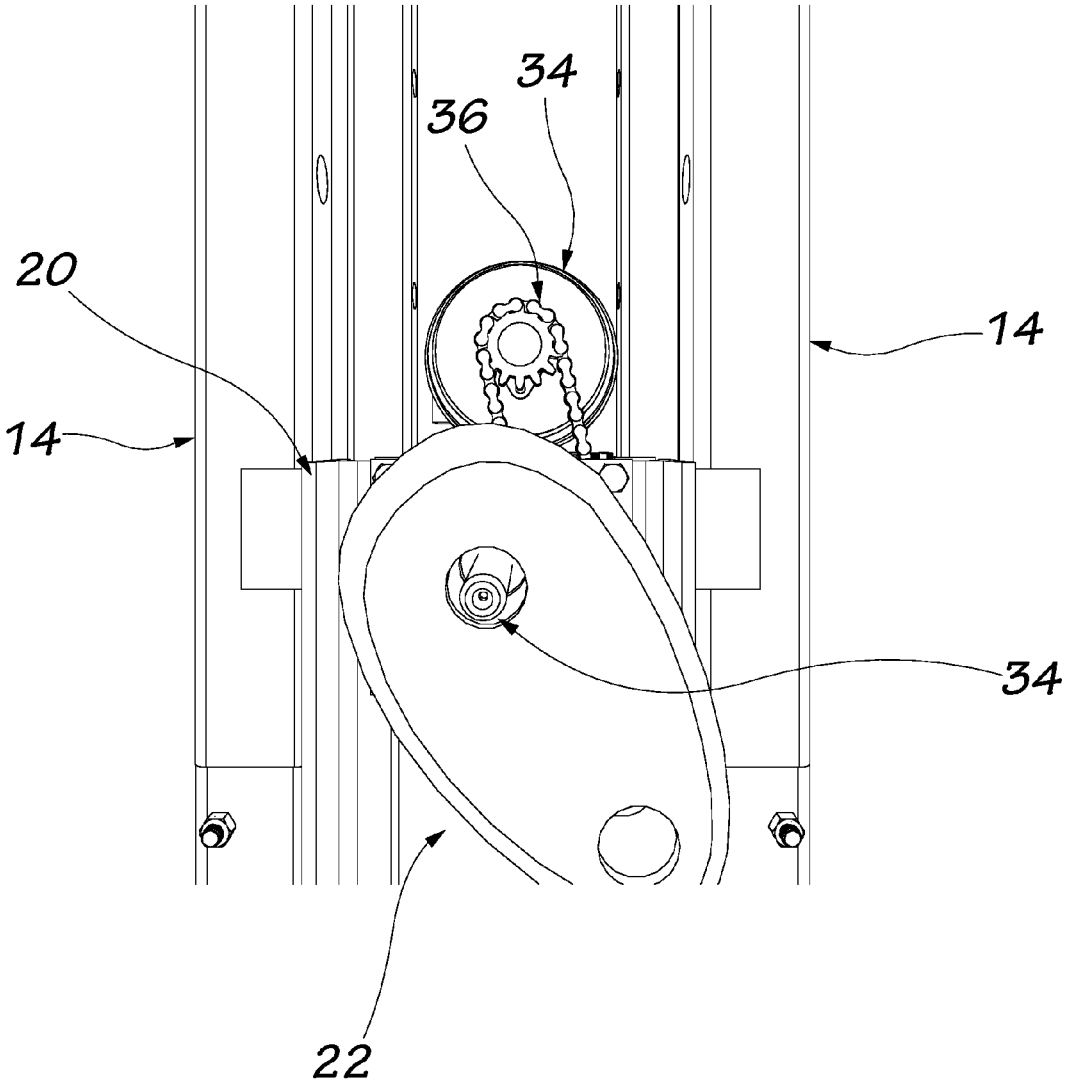
Figure 4C:
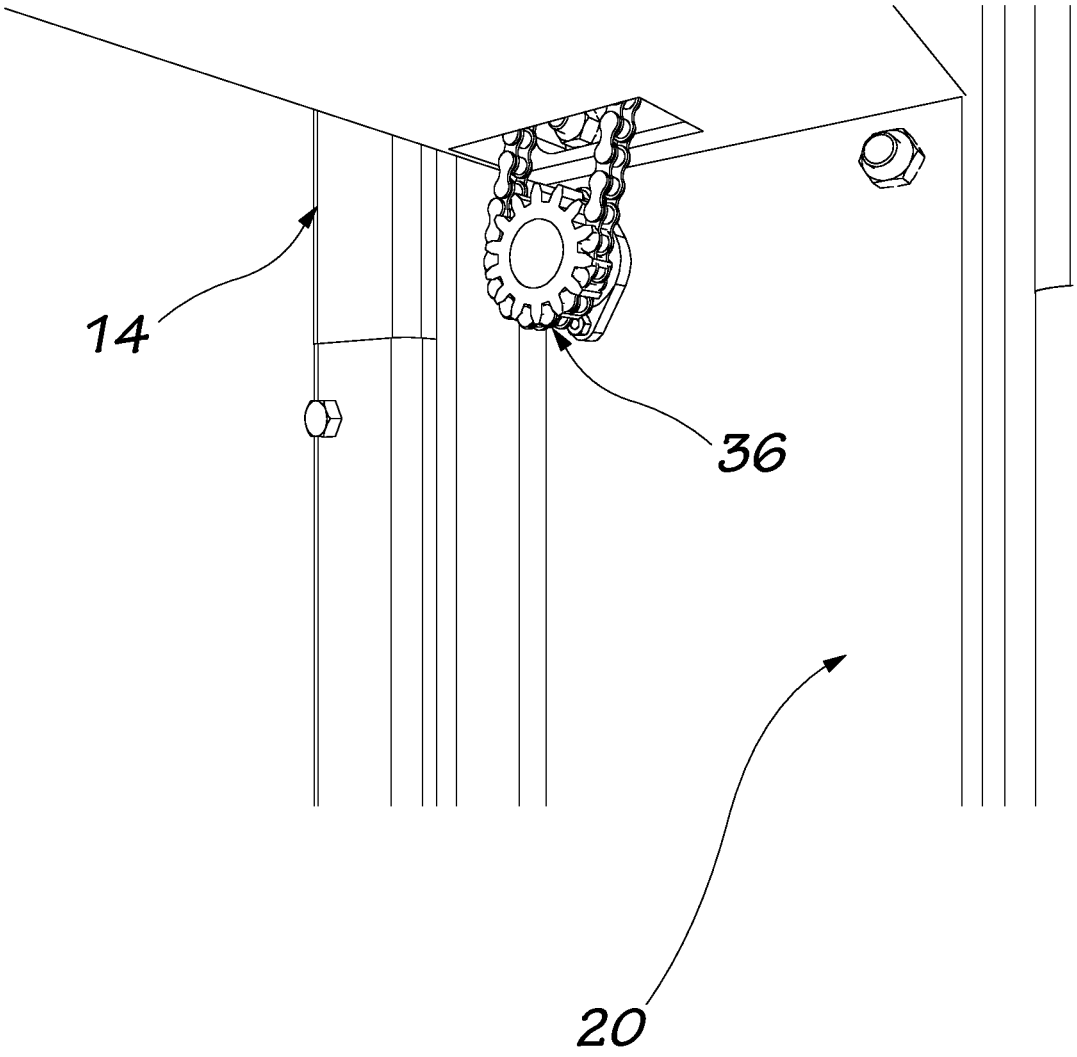
Figure 4D:
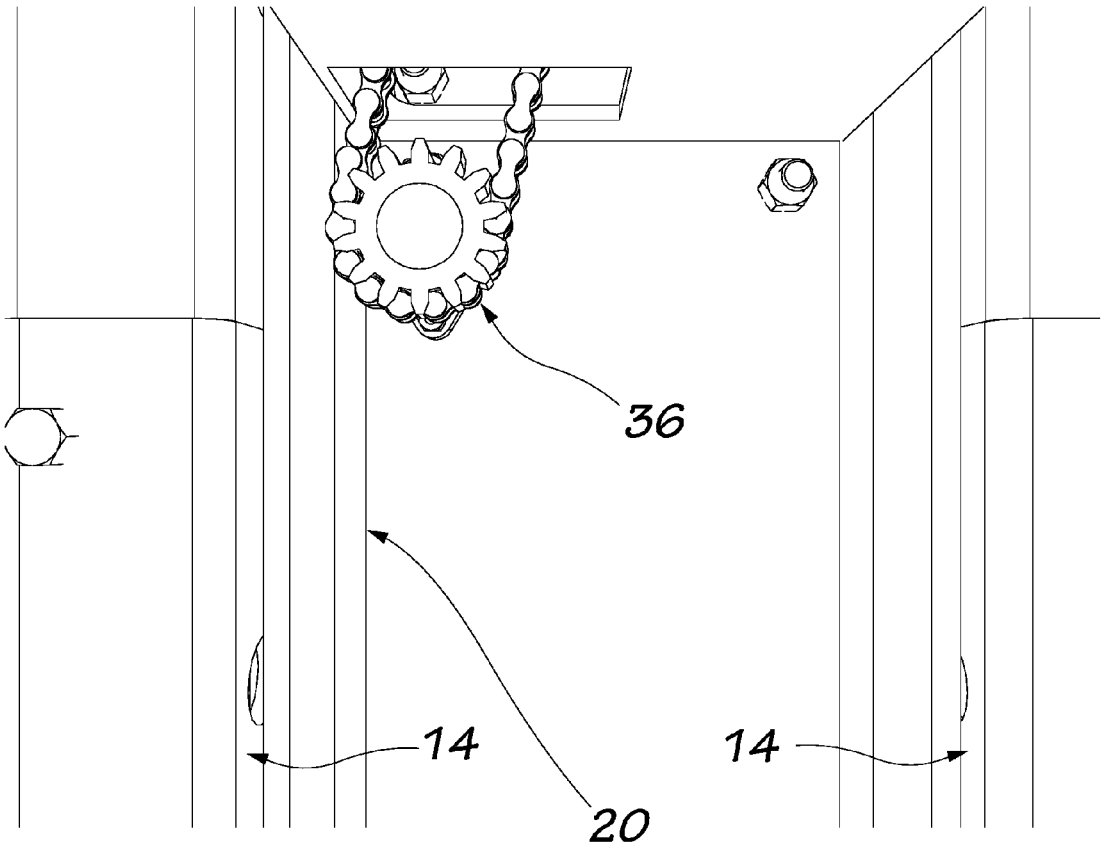
Figure 4E:
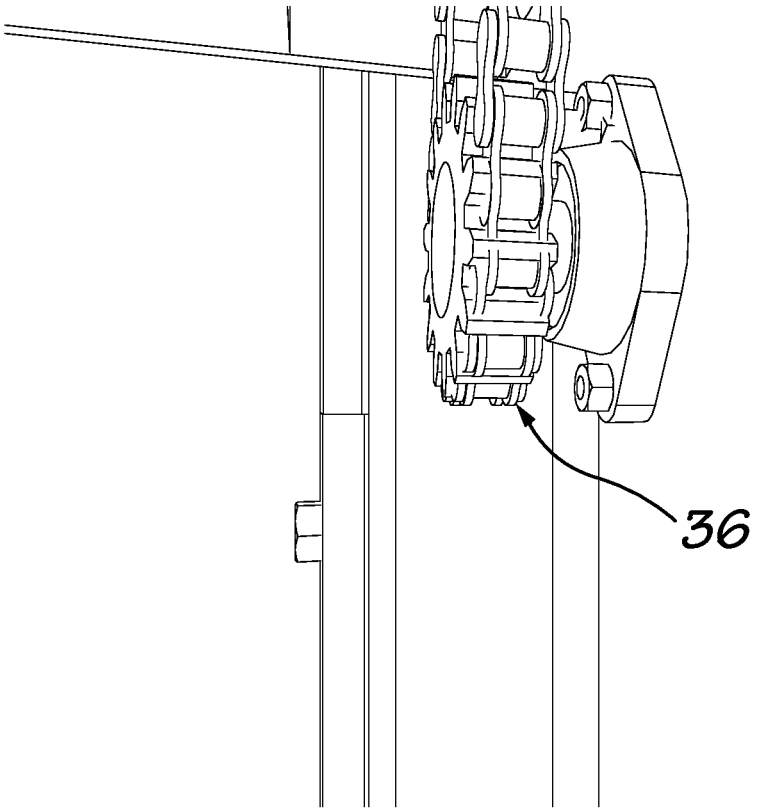
Figure 7A:
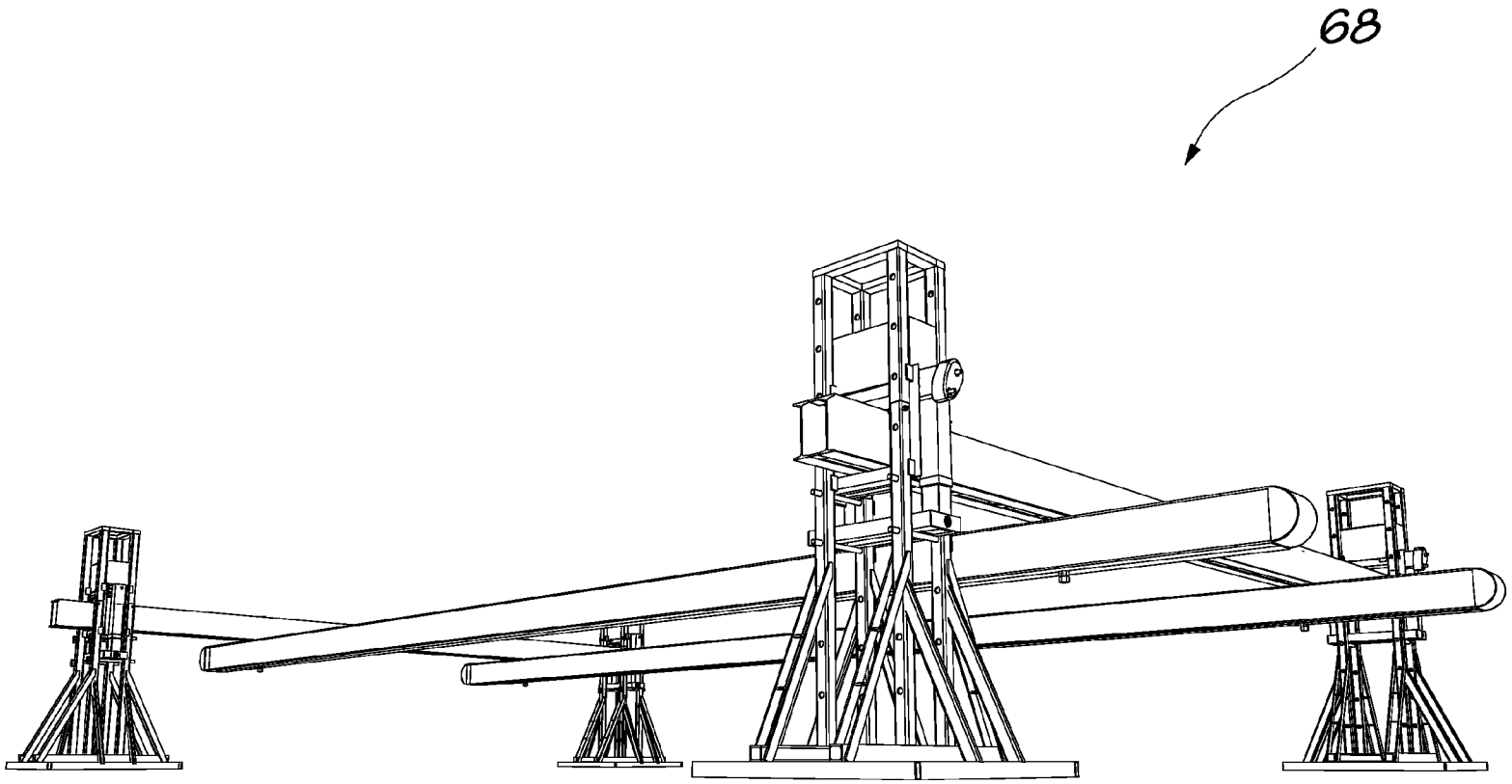
FIGS. 7*a* and 7*b* illustrate a system according to the present invention and a building being supported by the system.
Figure 7B:
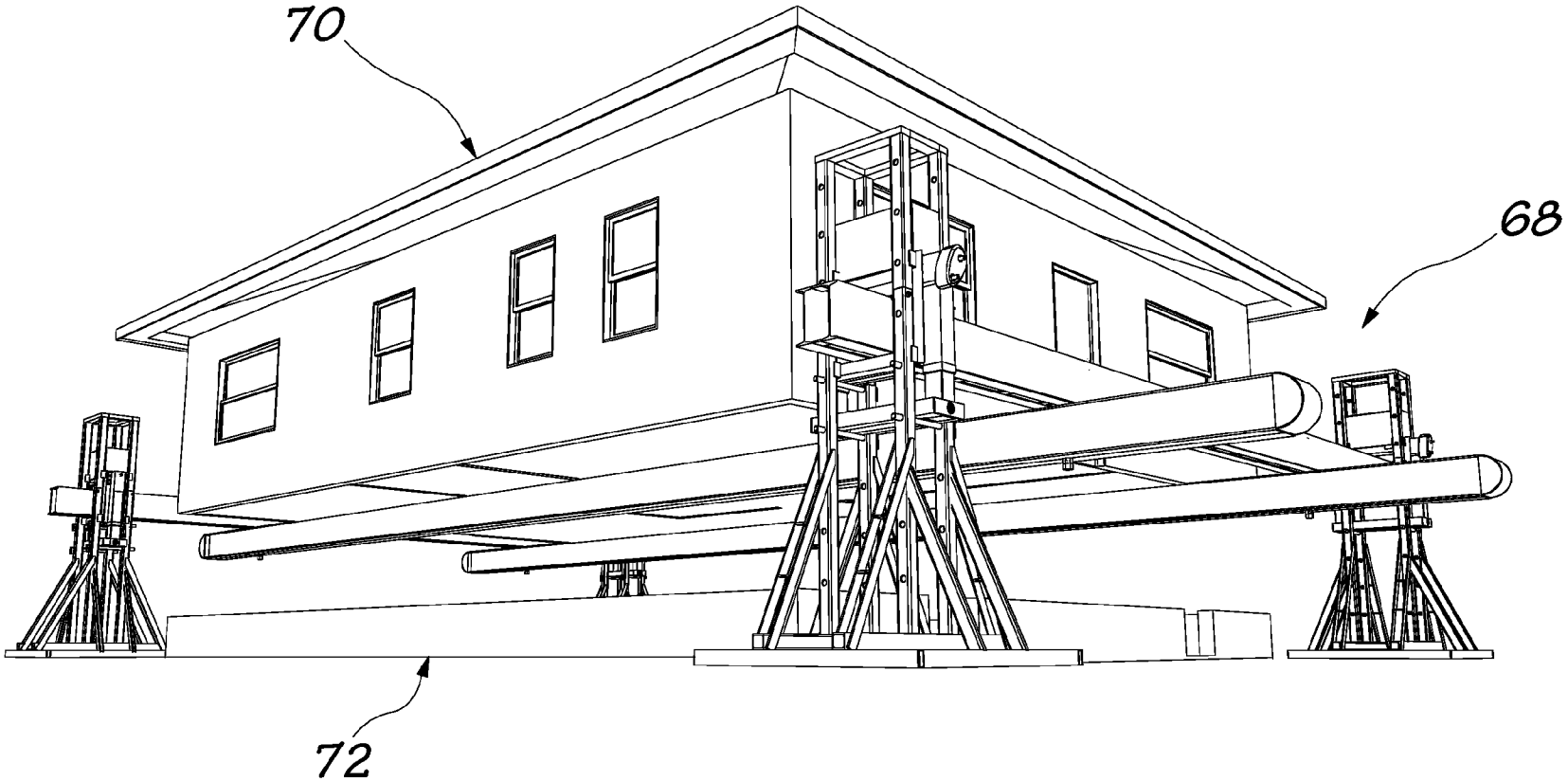

The yoke 20 comprises a lower support member on which the beam end sits, two spaced apart vertical members, and an upper housing 54 in which the motor 34 (shown in FIG. 4*b*) is housed, the various components defining the periphery of an aperture in which the beam end is received (as can best be seen in FIGS. 7*a* and 7*b*).

The vertical members of the yolk 20 are connected to housings for jack legs 22, 24. The jack legs 22, 24 can be separate from but connected to the yolk 20, or they can be integrated into the vertical members of the yolk 20 such that they extend from or retract into the yolk 20. The lower ends of the jack legs 22, 24 connect to a jack foot 26 which functions as the base for the jack mechanism of the exemplary apparatus. As will be discussed below, the chain drive 36 (shown in FIGS. 4*a* through 4*e*) works to extend or retract the jack legs 22, 24 (the jack leg 22 being directly powered by the chain drive 36, with a shaft 38 providing power to the other jack leg 24), such that the jack foot 26 moves away from or towards the lower support member of the yolk 20. Detailed illustrations of an exemplary chain drive are shown in FIGS. 4*a* through 4*e*.

The masts 14 are provided with a series of holes 28 sized to receive locking pins 32, the holes 28 positioned at spaced intervals in the vertical. The yolk 20 is also provided with holes 30 which are also sized to receive the locking pins 32 (shown in FIG. 3*g*). The yolk 20 can accordingly be releasably locked in a certain position on the guide 12 by means of inserting the pins 32 through the holes 28, 30 when aligned, as discussed below.

The apparatus 10 is intended for use in the lifting of buildings, and accordingly the materials from which it is made must be sufficiently robust and stable. Steel is the preferred material to use in manufacturing the apparatus 10, and the particular specifications will depend on the proposed applications. Although various motors and chain drives could be used with the present invention, and those skilled in the art would easily be able to identify suitable components, a Baldor™ industrial motor and Cone Drive are preferred.

Turning now to FIGS. 2*a* through 2*d*, an exemplary system 40 according to the present invention is illustrated. The illustrated system 40 comprises four towers 42 (which are shown as substantially similar to the tower 10 described above), two of which would be positioned on an opposite side of the target building from the other two. Two primary lifting beams 44 are positioned beneath the target building and provide support as the building is lifted to the desired height. The primary lifting beams 44 are connected to secondary lifting beams 46 by means of connectors 50, which connectors 50 are to be selected based in part on weight bearing capacity but may take the form of bolts, such that the two secondary lifting beams 46 are located on opposite sides of the target building. The ends of the secondary lifting beams 46 are received in the yolks 48 (which are shown as substantially similar to the yolk 20 described above) of the towers 42, such that actuation of the jacks 52 raises or lowers the yolks 48 and accordingly the ends of the secondary beams 46, which in turn raises or lowers the primary beams 44 to raise or lower the target building. The primary beams 44 preferably depend from the lower surfaces of the secondary beams 46 as the primary beams 44 are normally set low to the ground surface to be inserted between the building and its foundations. FIGS. 7*a* and 7*b* illustrate a comparable system 68 being used to lift a building 70 off of its foundations 72.

In the event that the target building is longer than the primary lifting beams 44, it is within the scope of the present invention to extend the length of the primary beams 44. Each primary beam 44 is shown as having a rounded end, and these rounded ends can be manufactured as detachable, such that one or more detachable primary beam sections (not shown) can be inserted and the rounded end replaced before use, thereby enabling lifting of longer buildings.

Figure 3A:
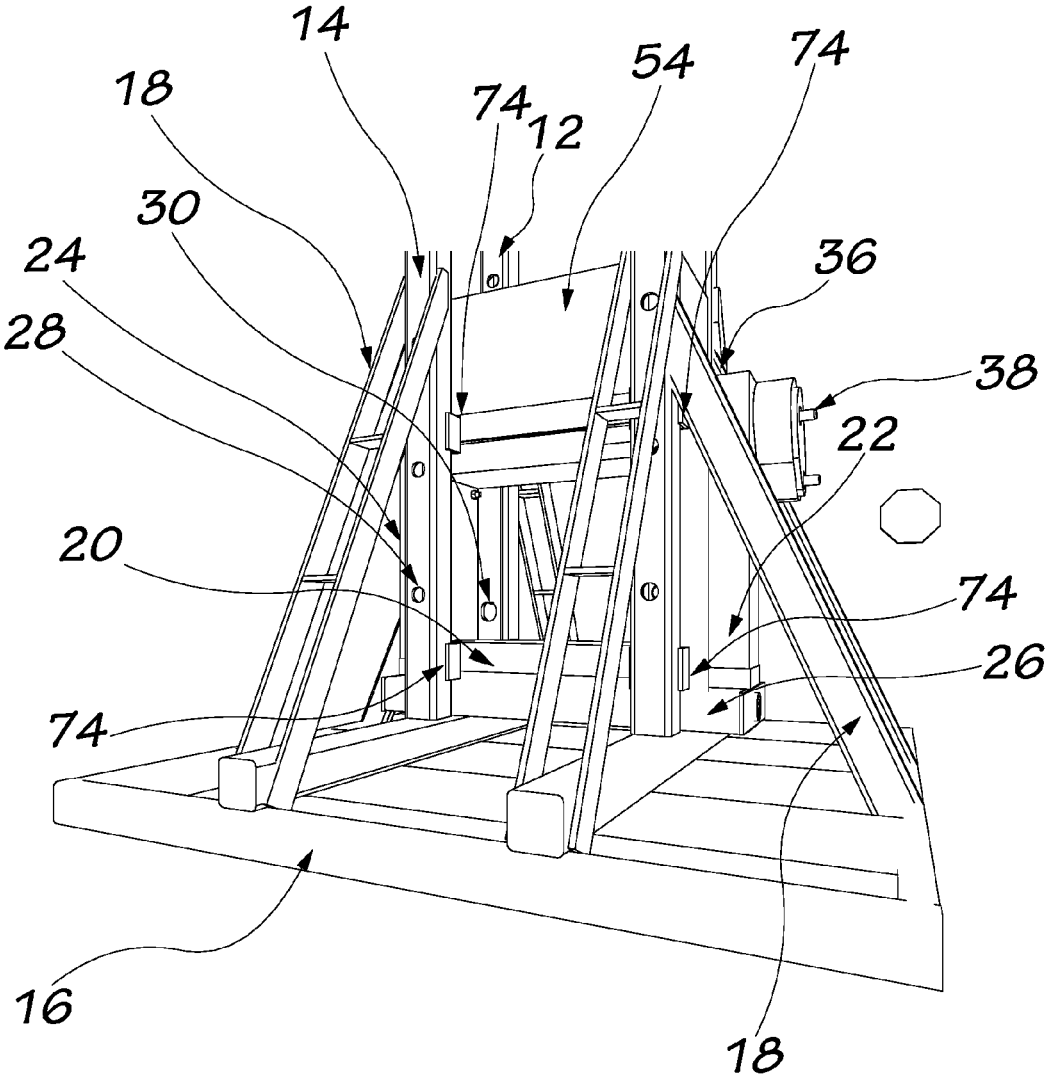
FIGS. 3*a* through 3*z* are front perspective views of a guide tower according to the present invention at various points during lifting of a beam.
Figure 3B:
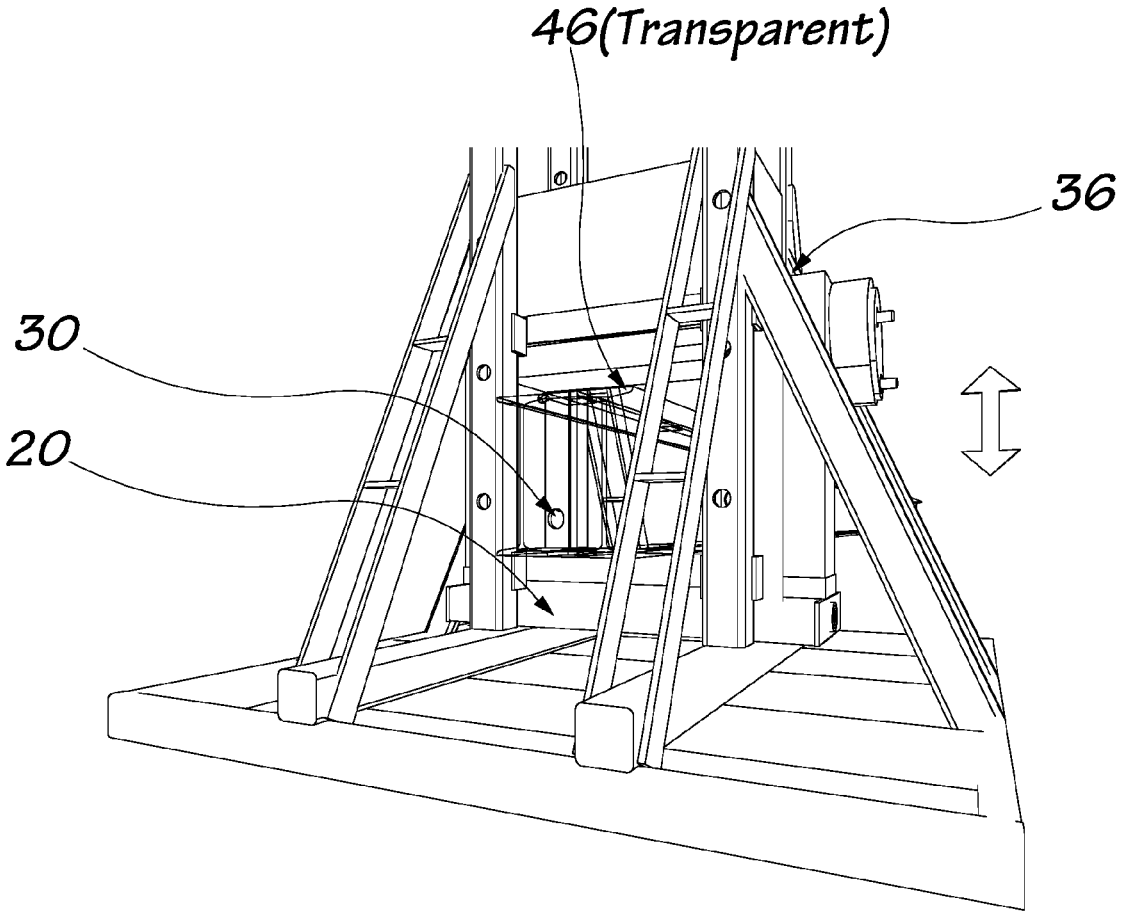
Figure 3C:
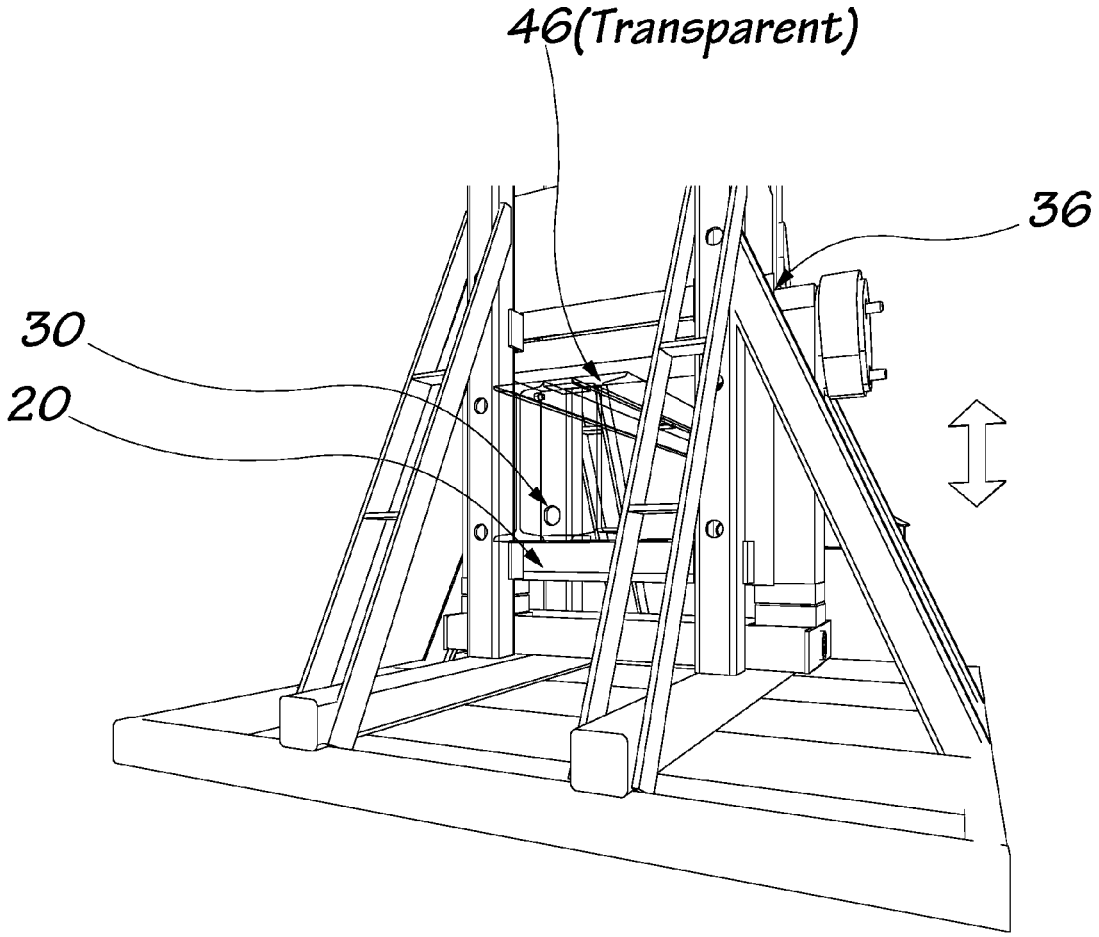
Figure 3D:
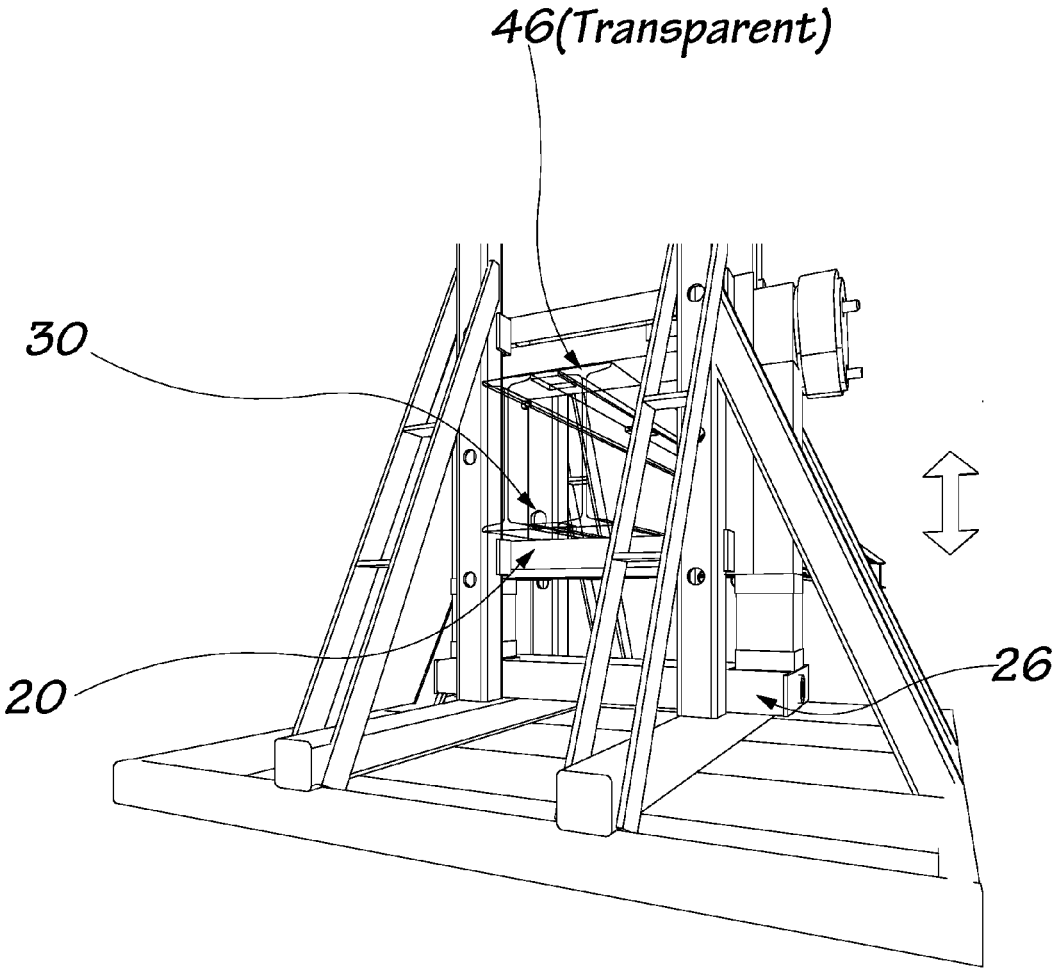
Figure 3E:
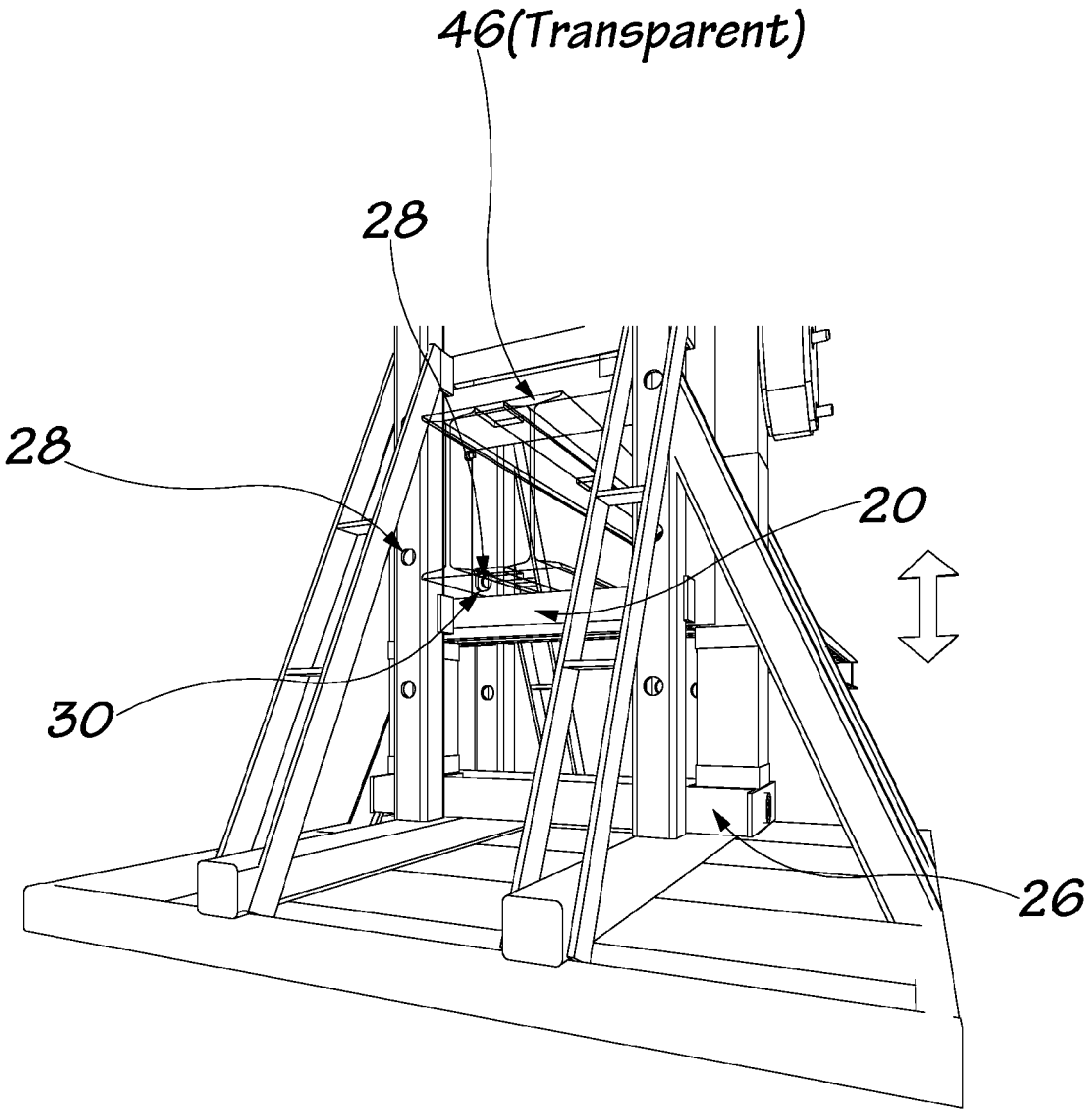
Figure 3F:
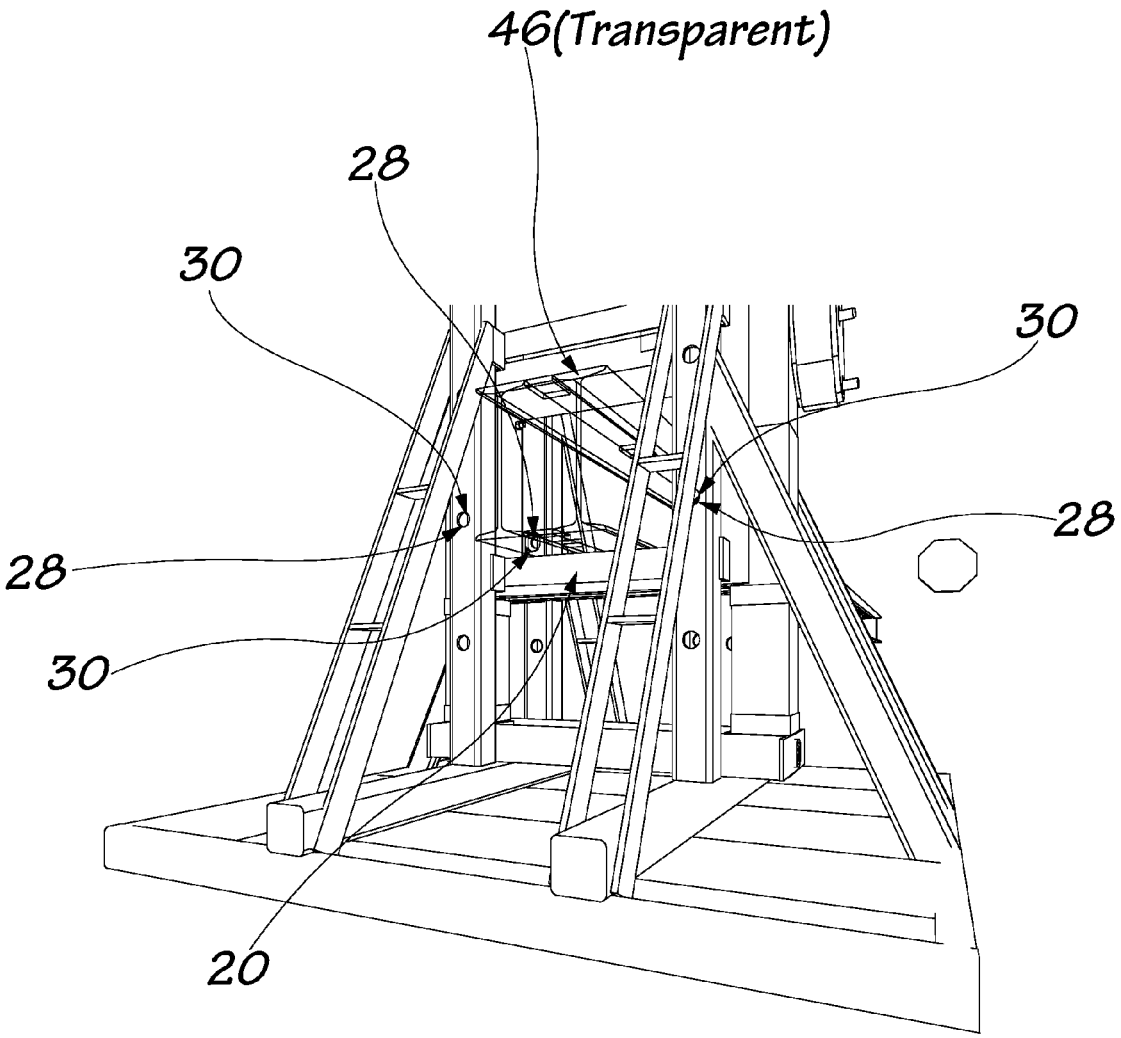
Figure 3G:
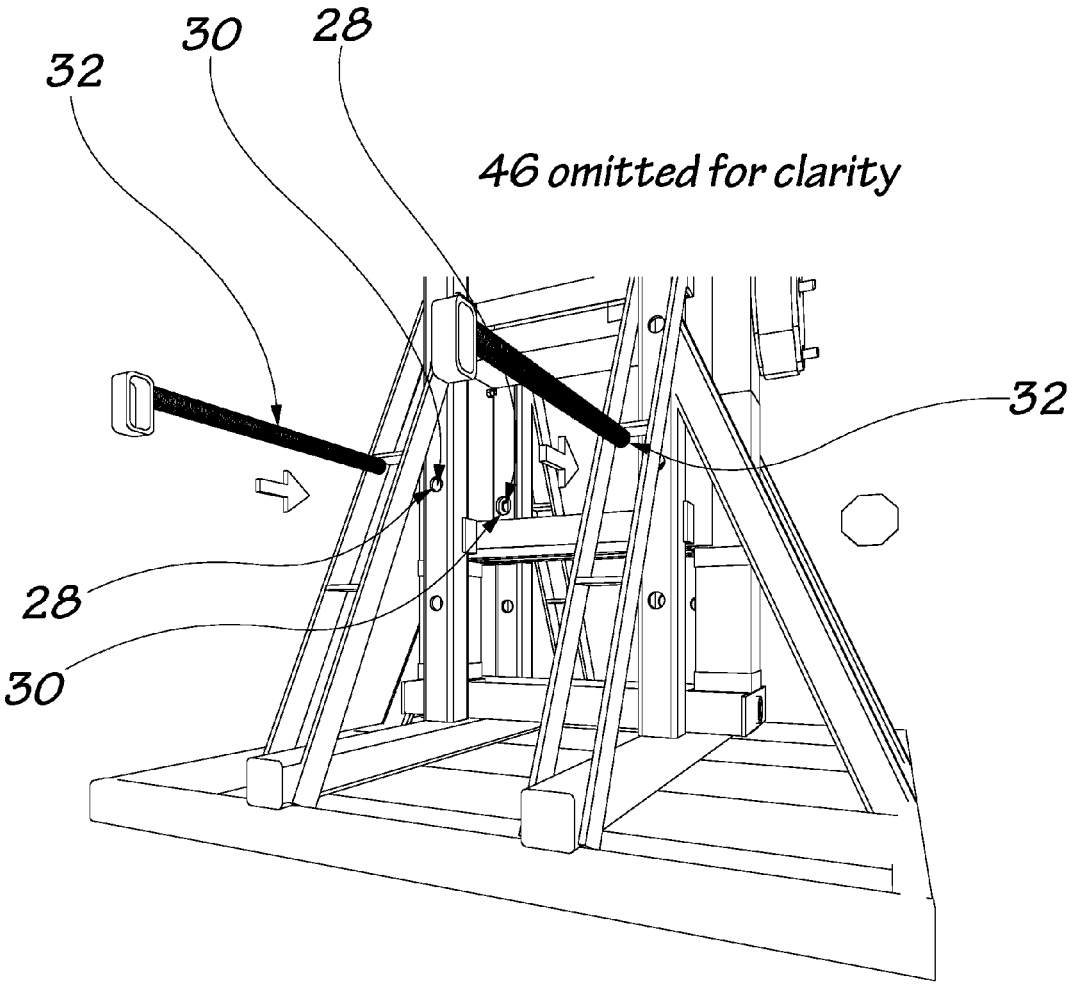
Figure 3H:
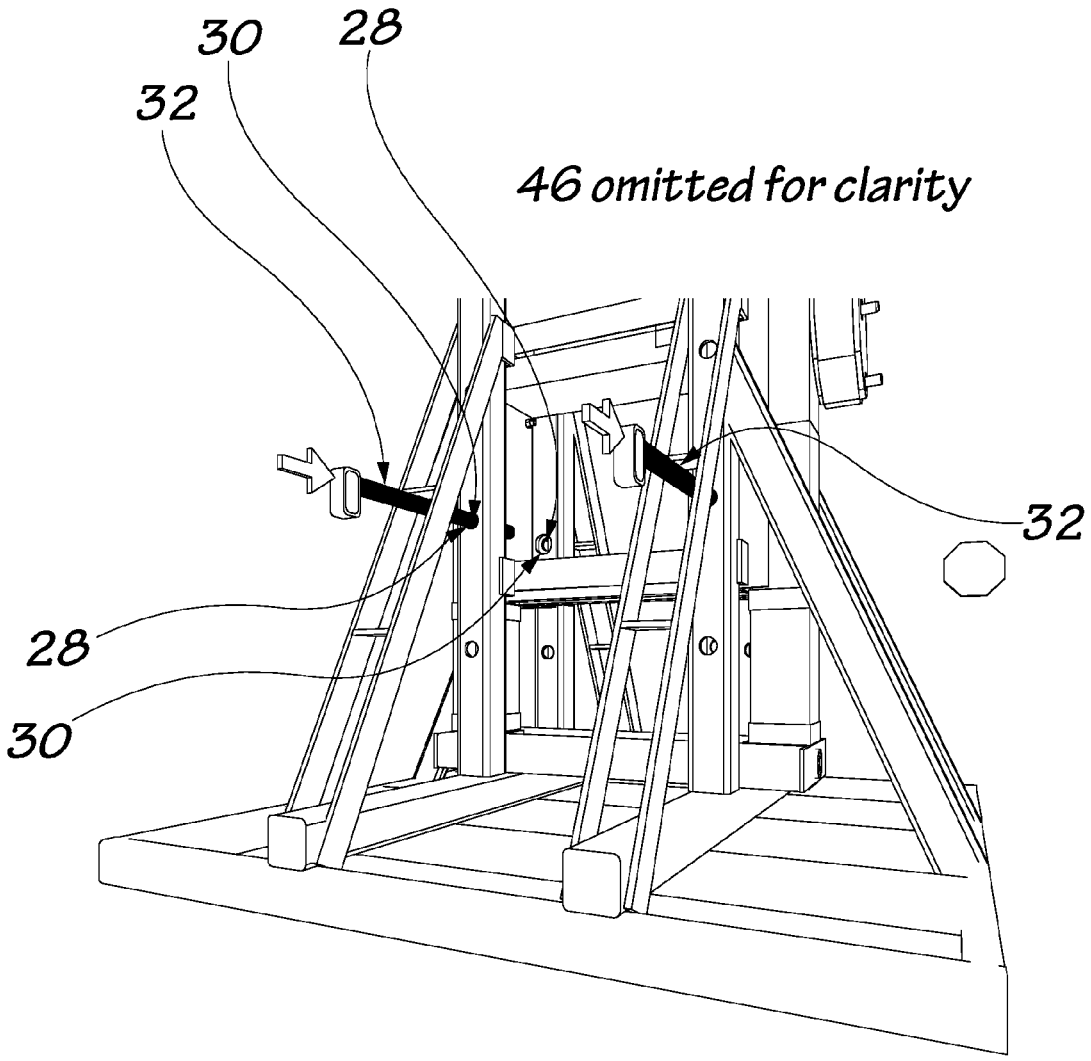
Figure 3I:
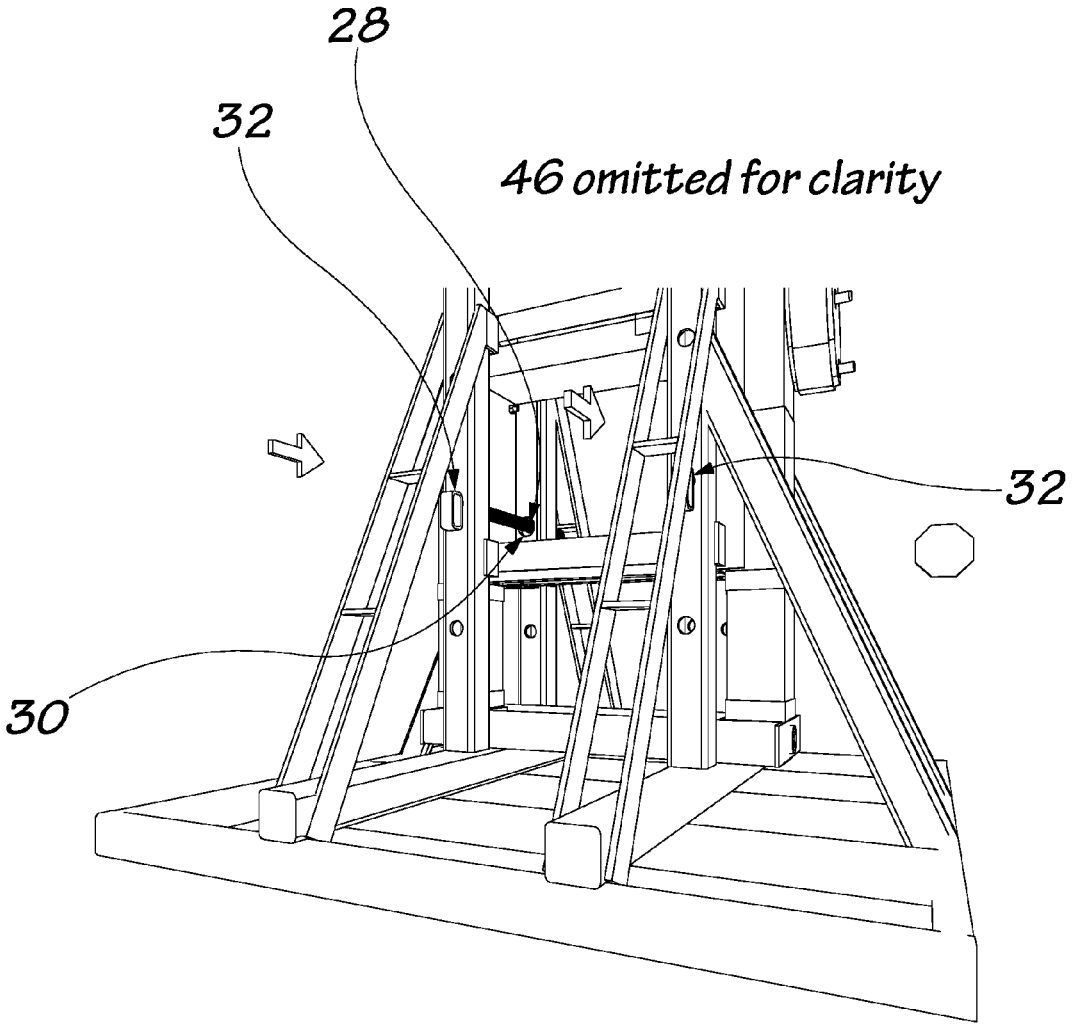
Figure 3J:
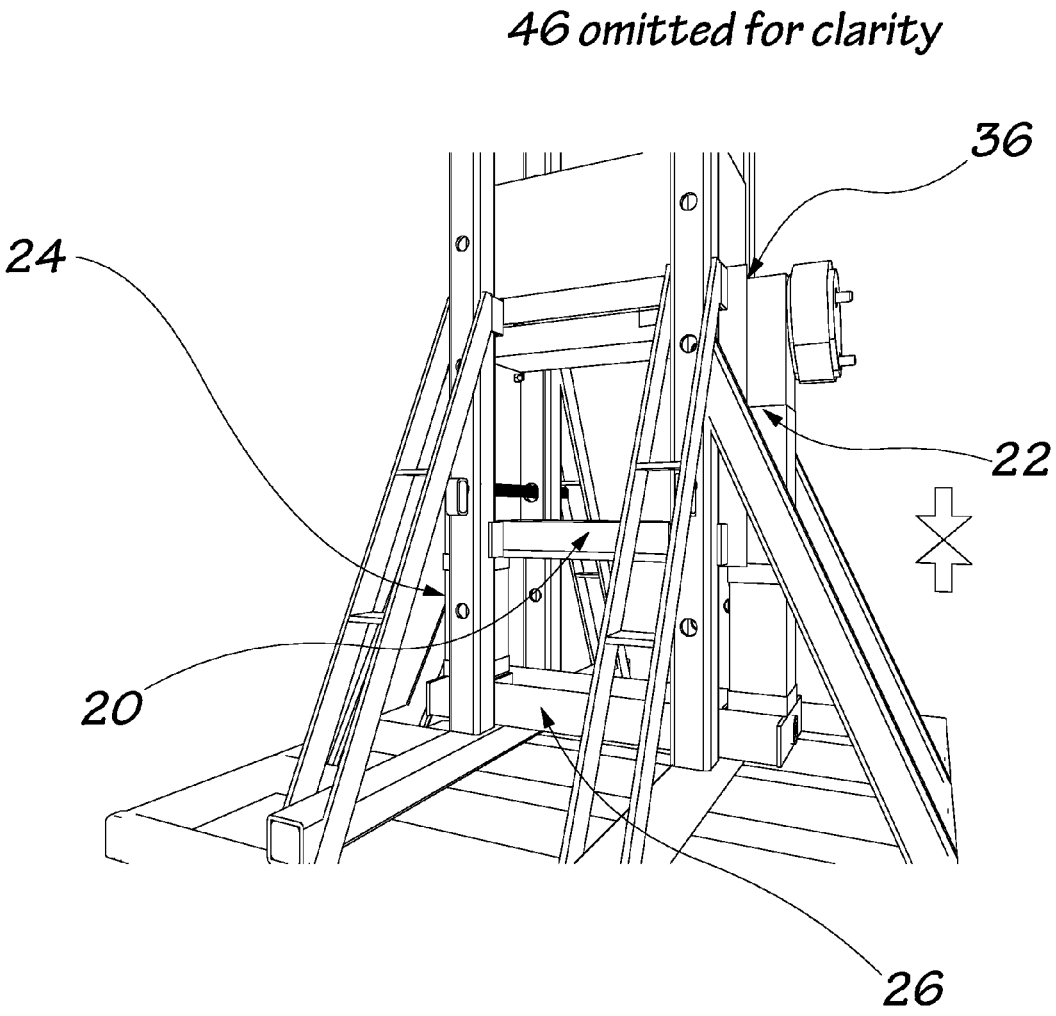
Figure 3K:
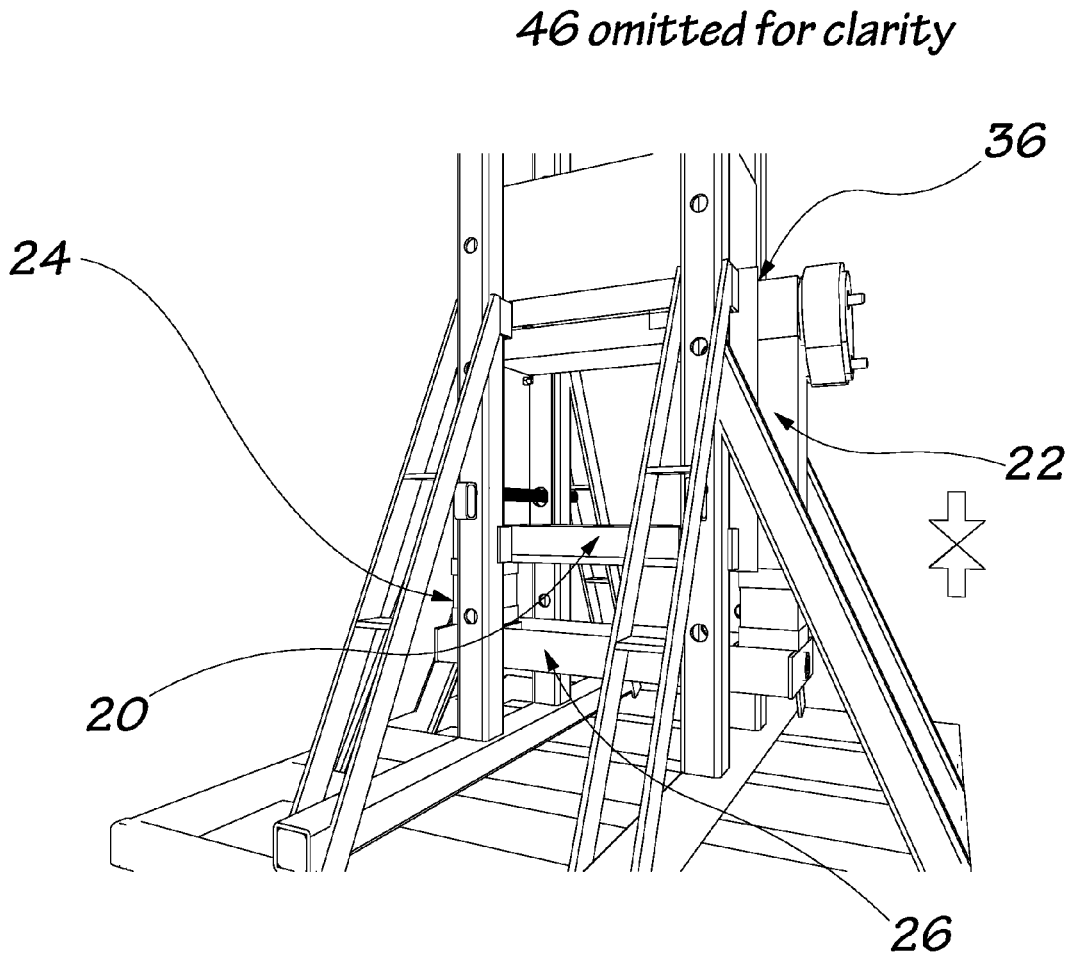
Figure 31:
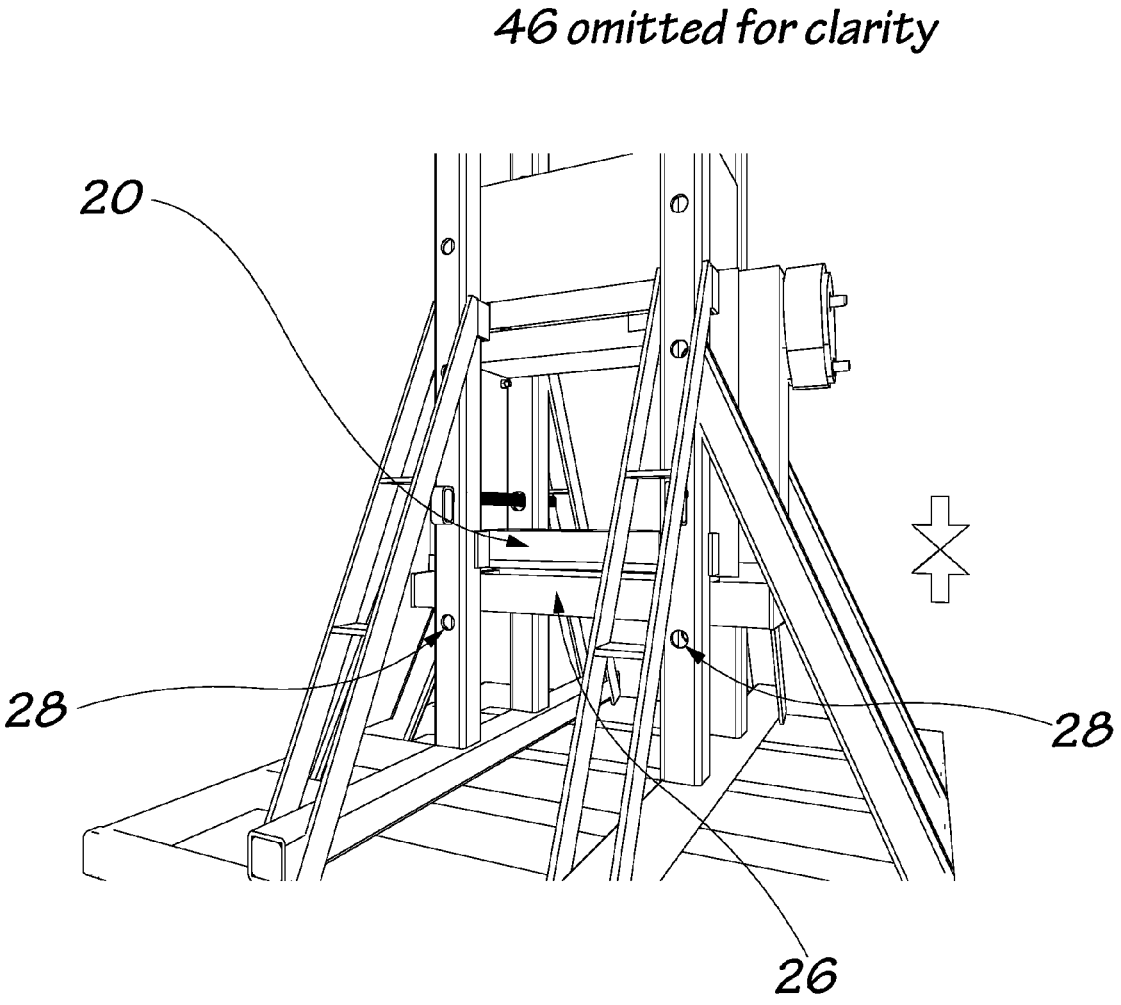
Figure 3M:
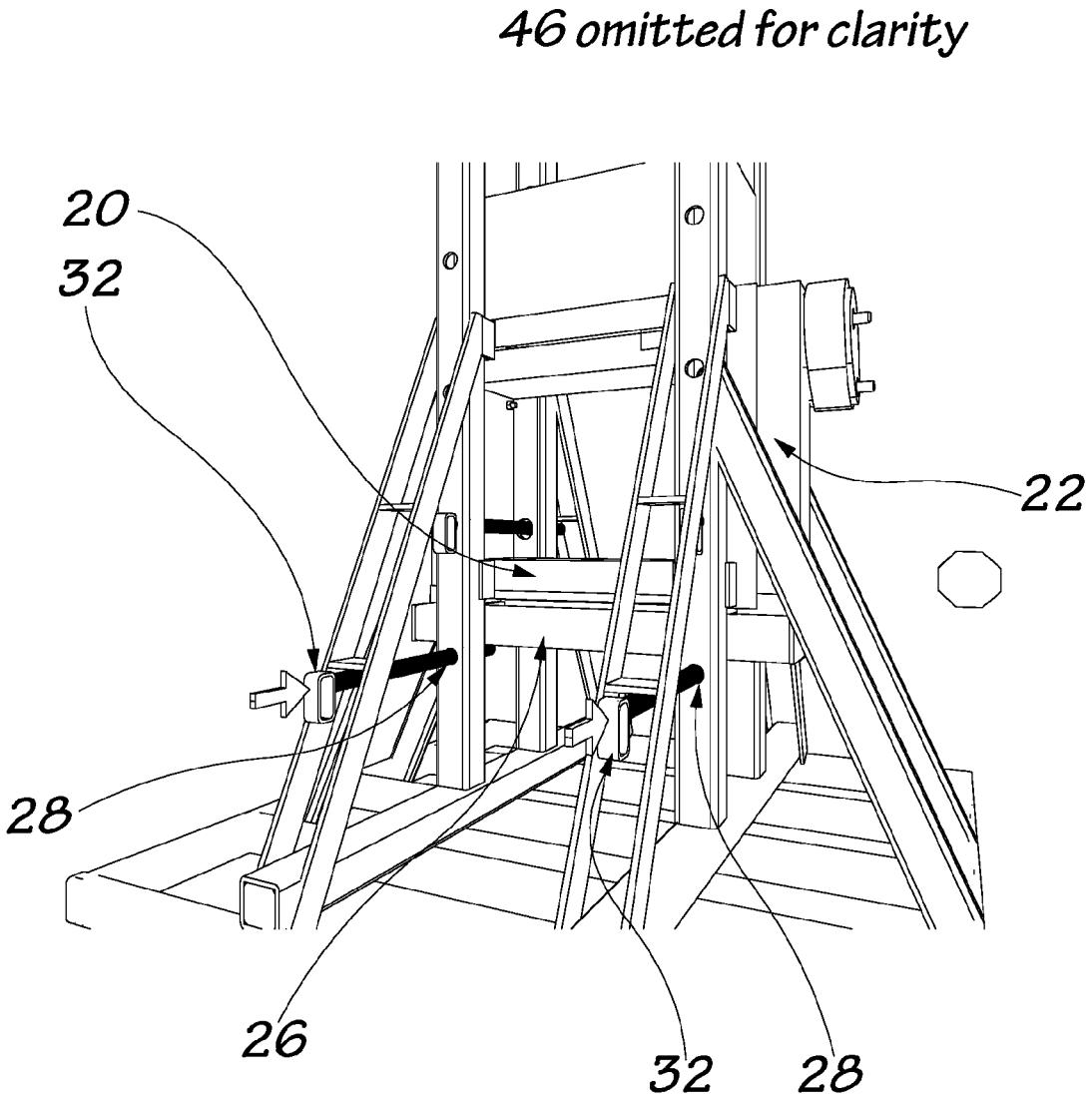
Figure 3N:
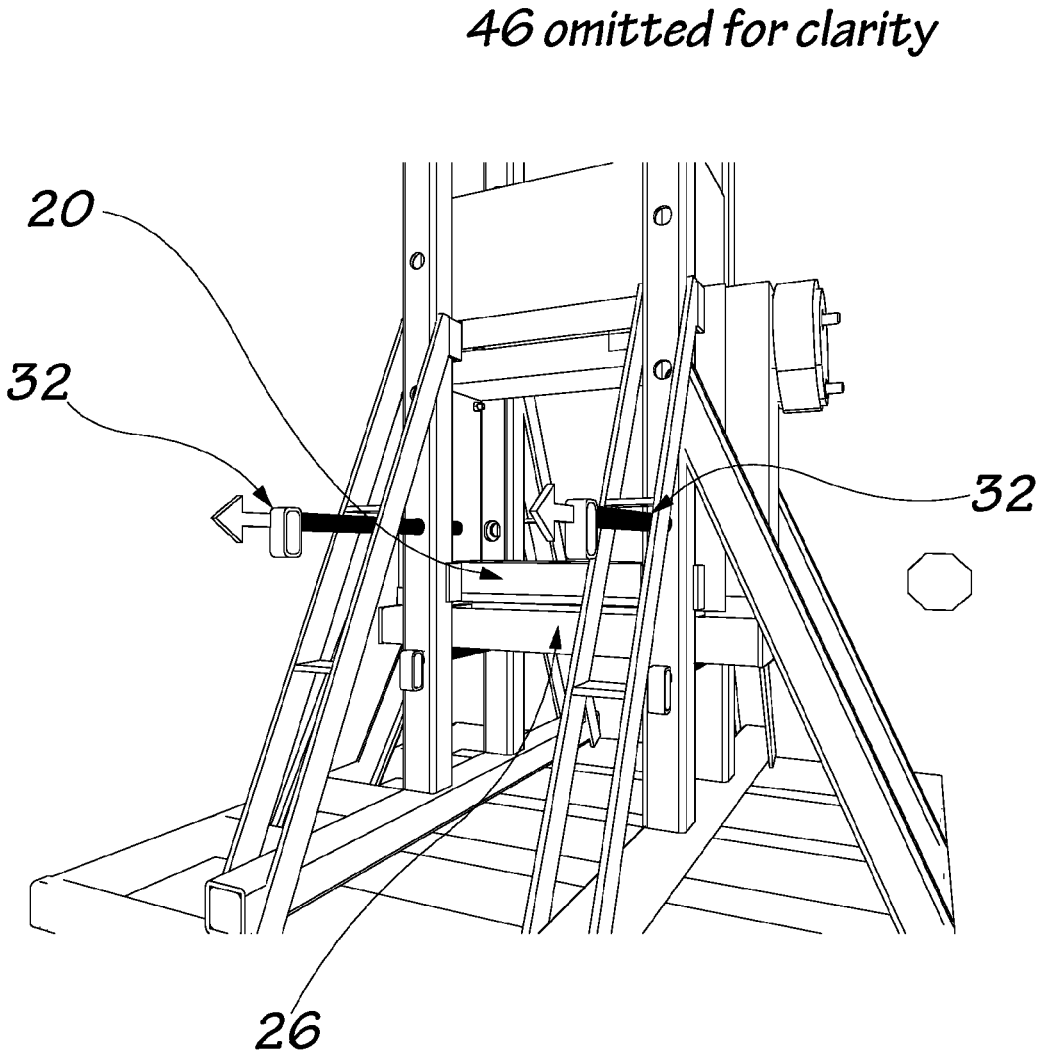
Figure 3O:
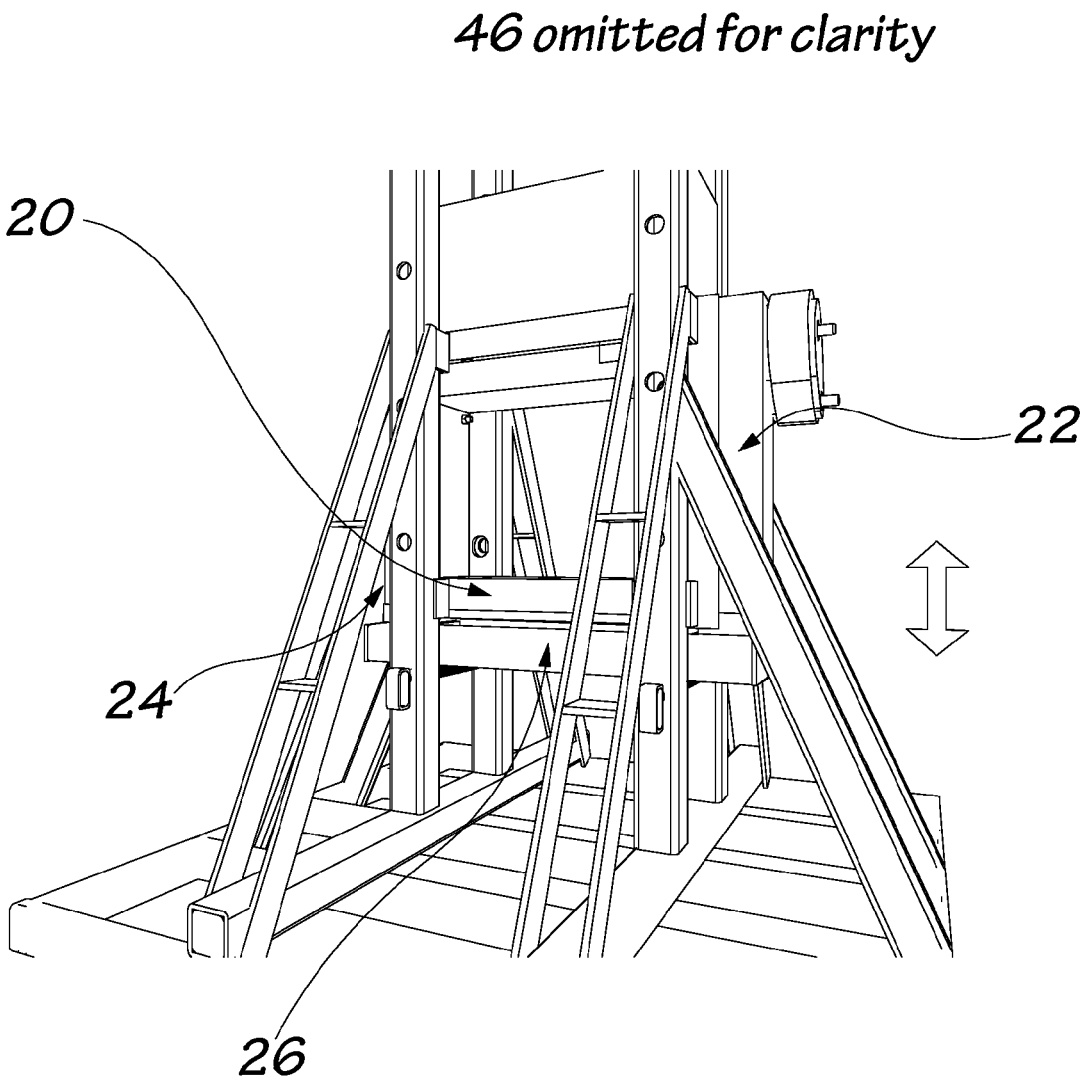
Figure 3P:
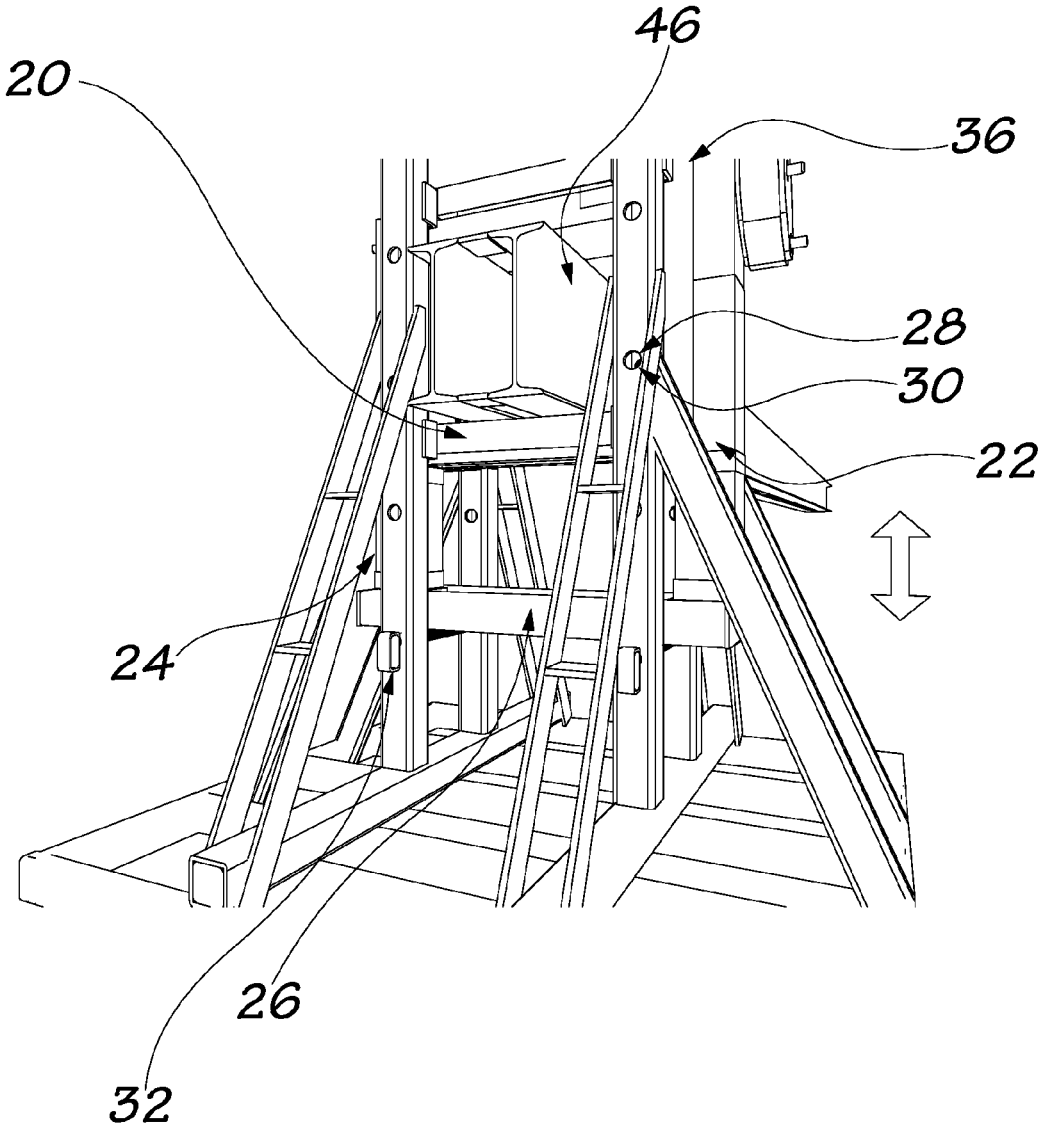
Figure 3Q:
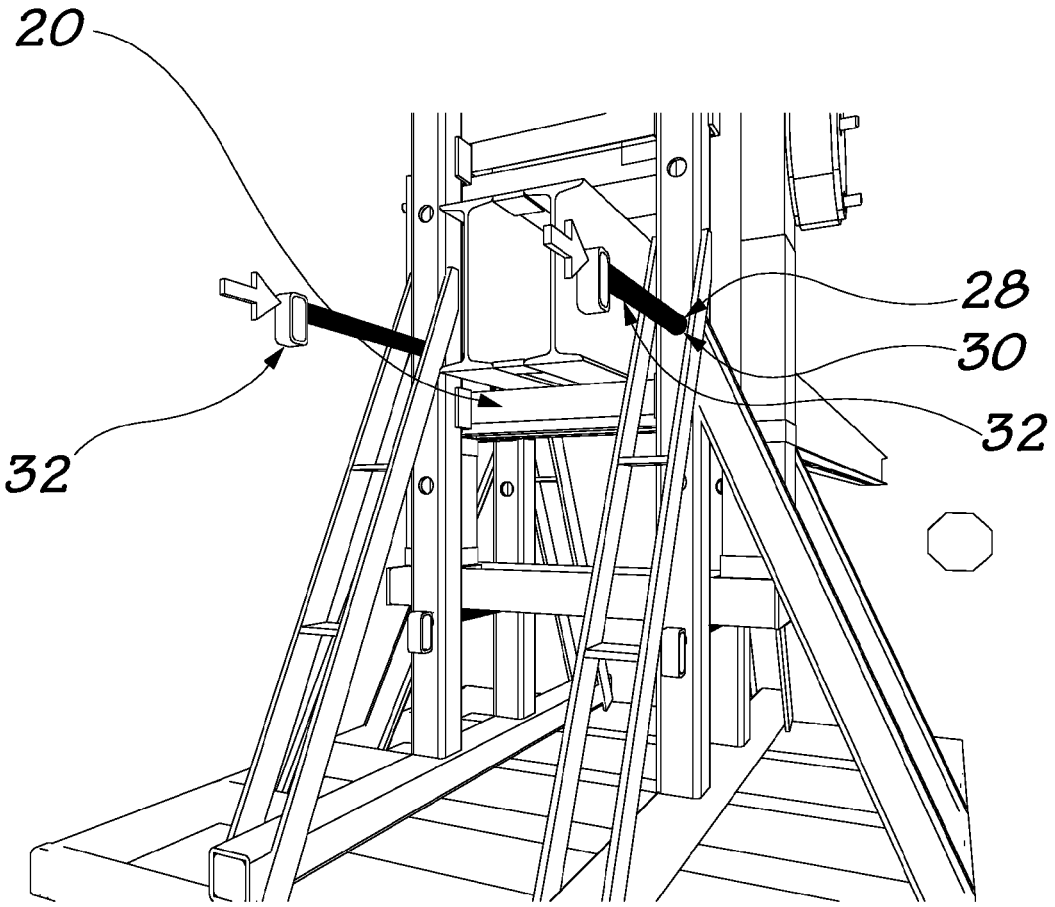
Figure 3R:
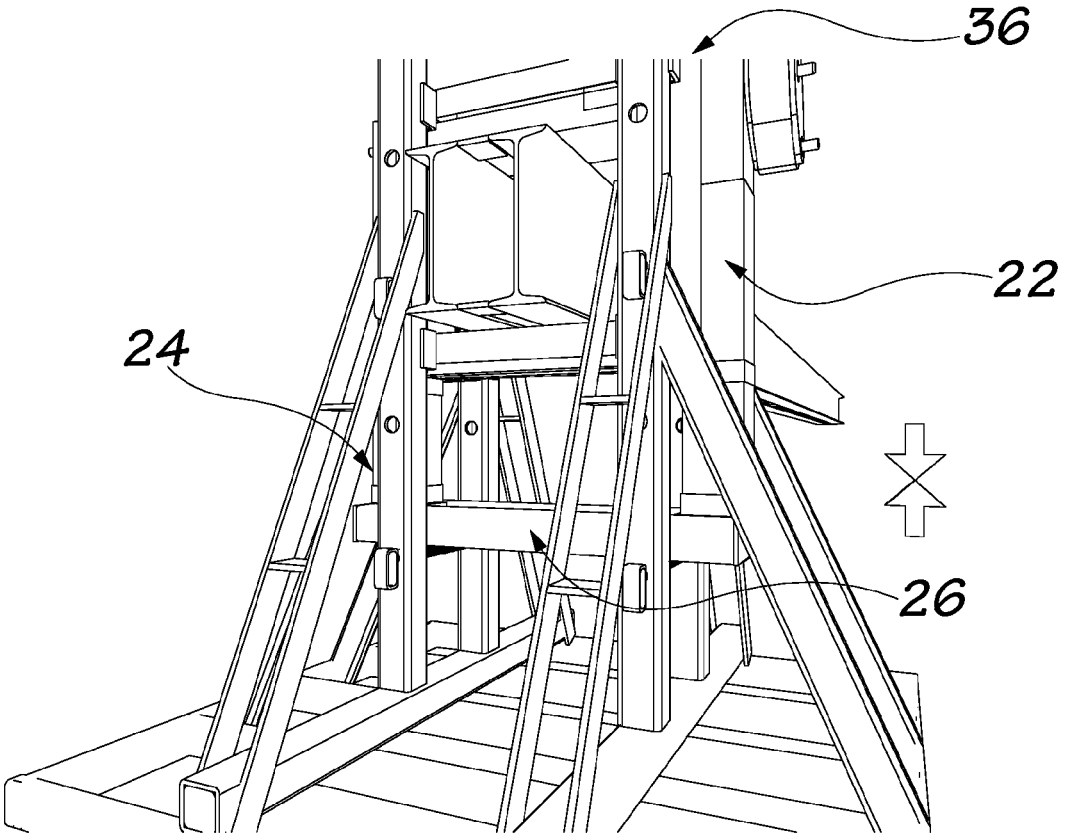
Figure 3S:
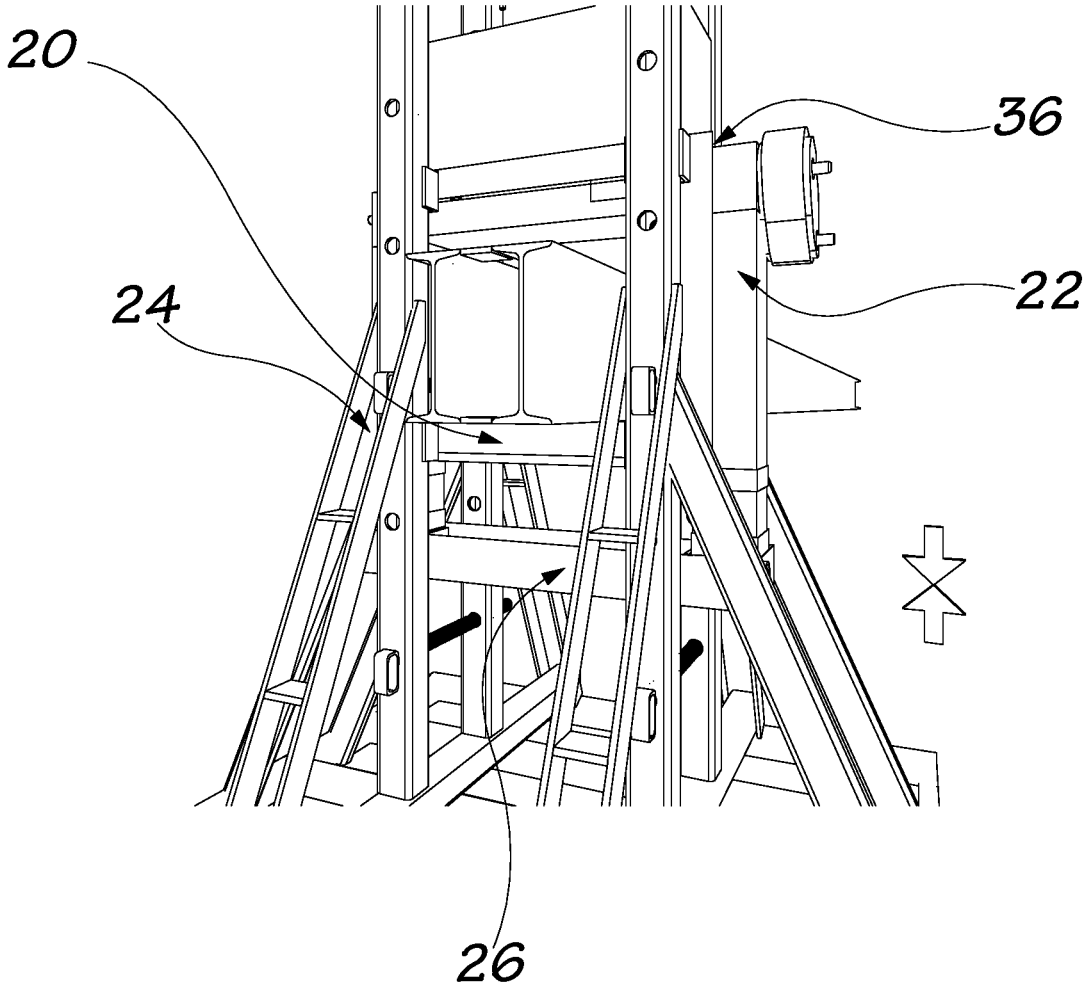
Figure 3T:
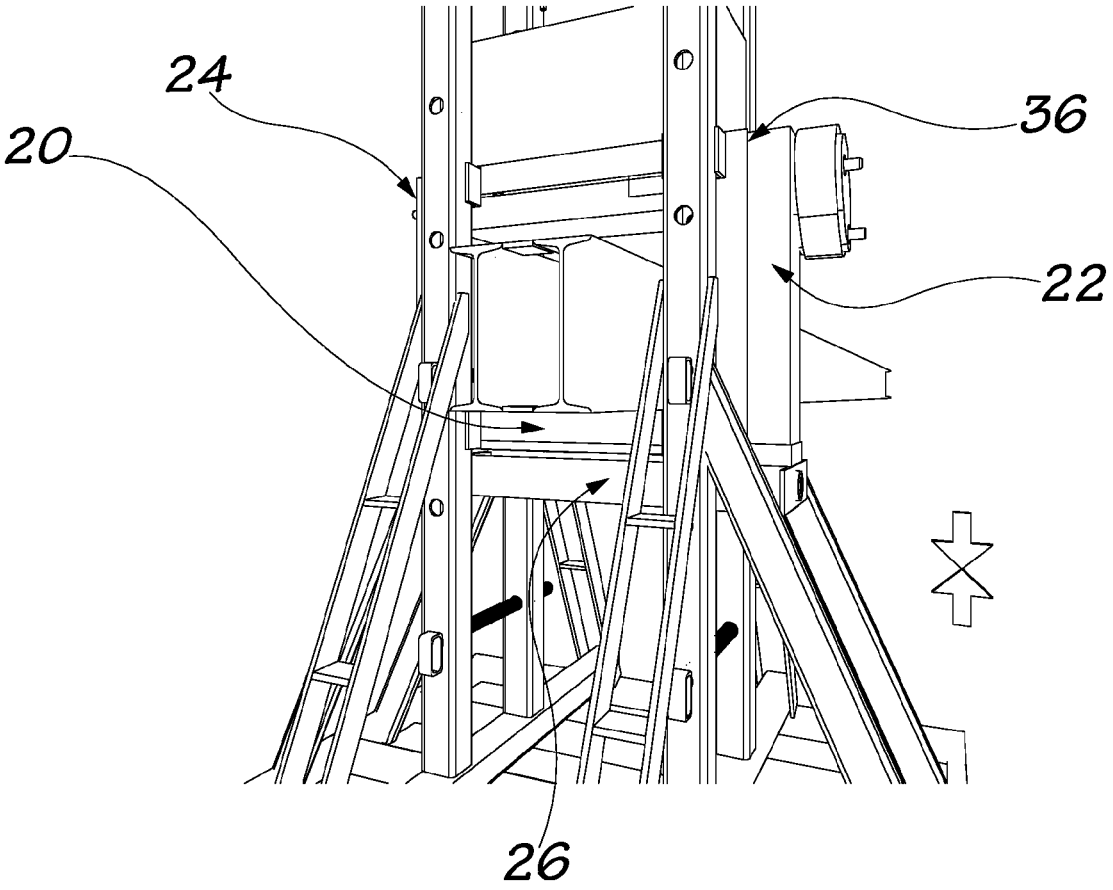
Figure 3U:
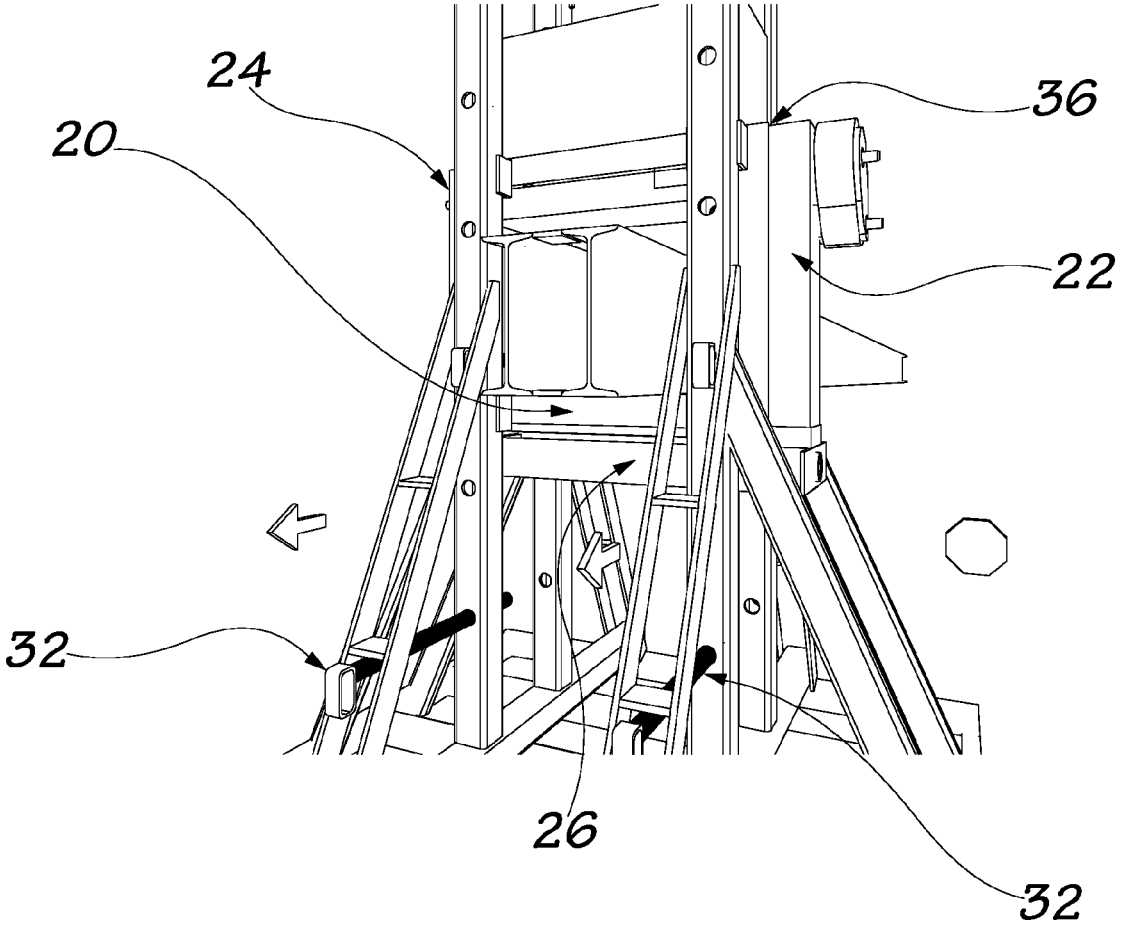
Figure 3V:
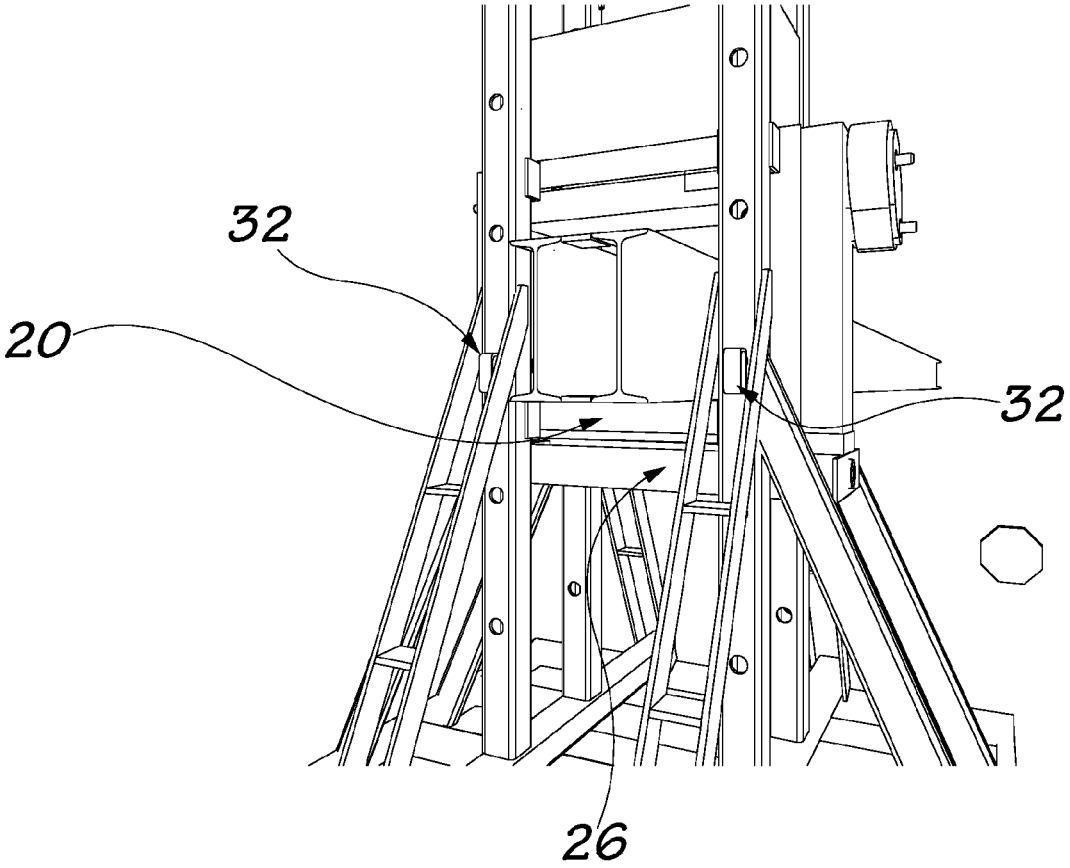
Figure 3W:
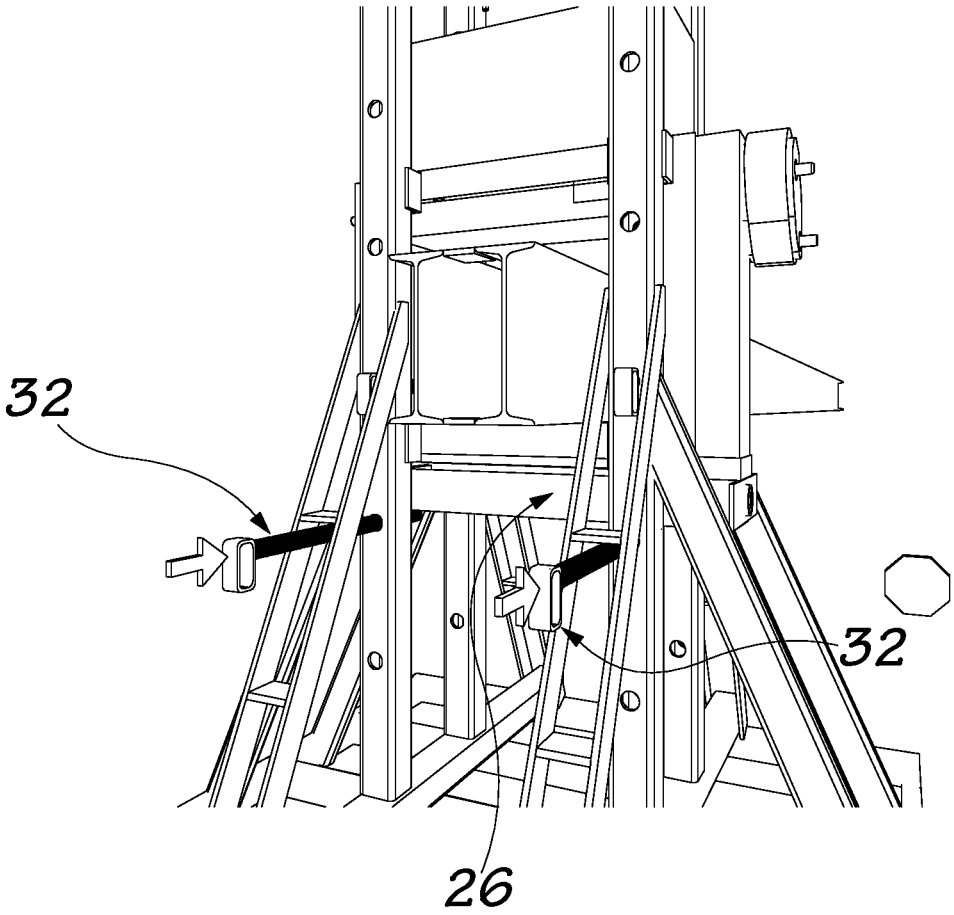
Figure 3X:
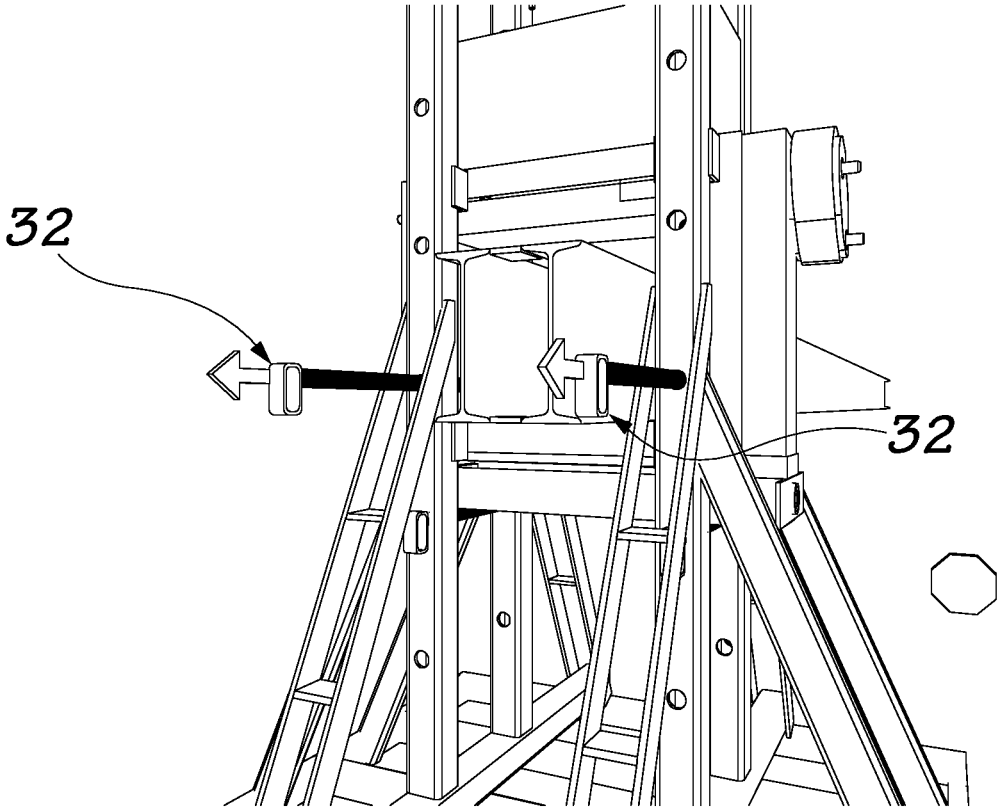
Figure 3Y:
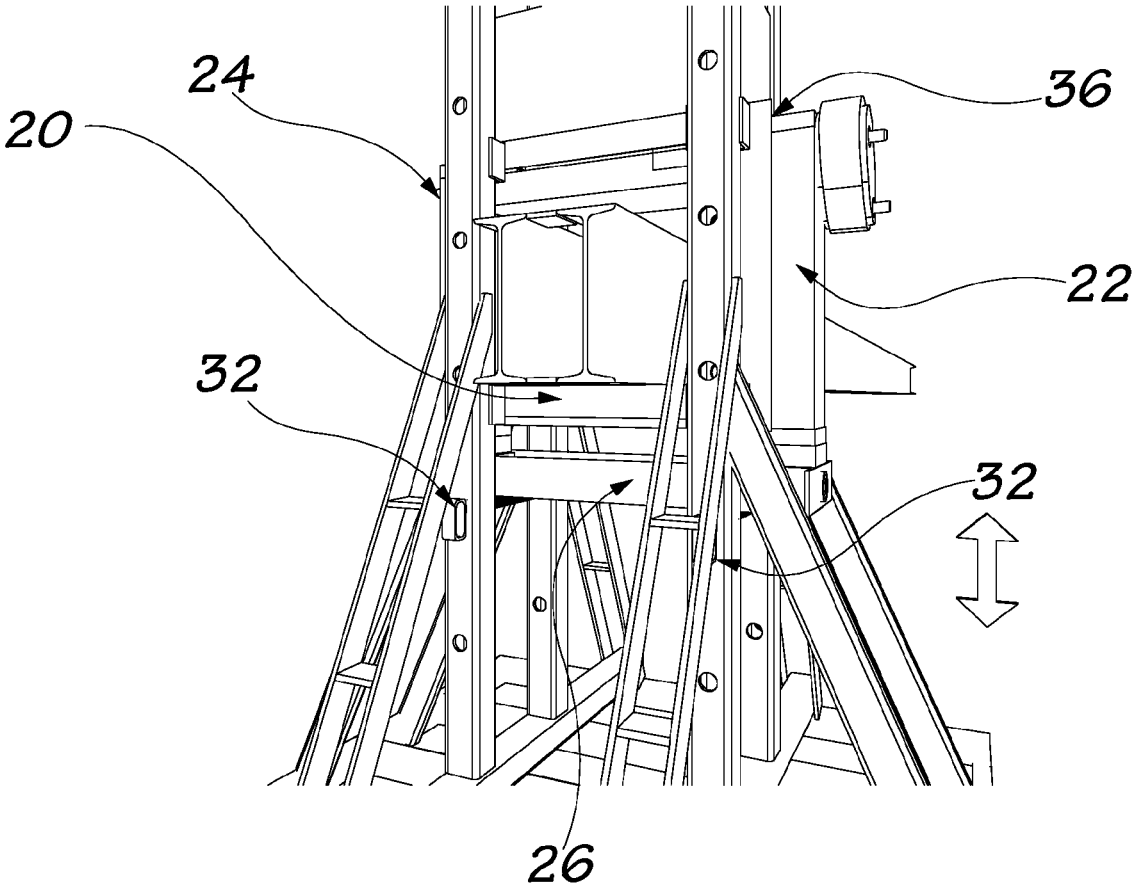
Figure 3Z:
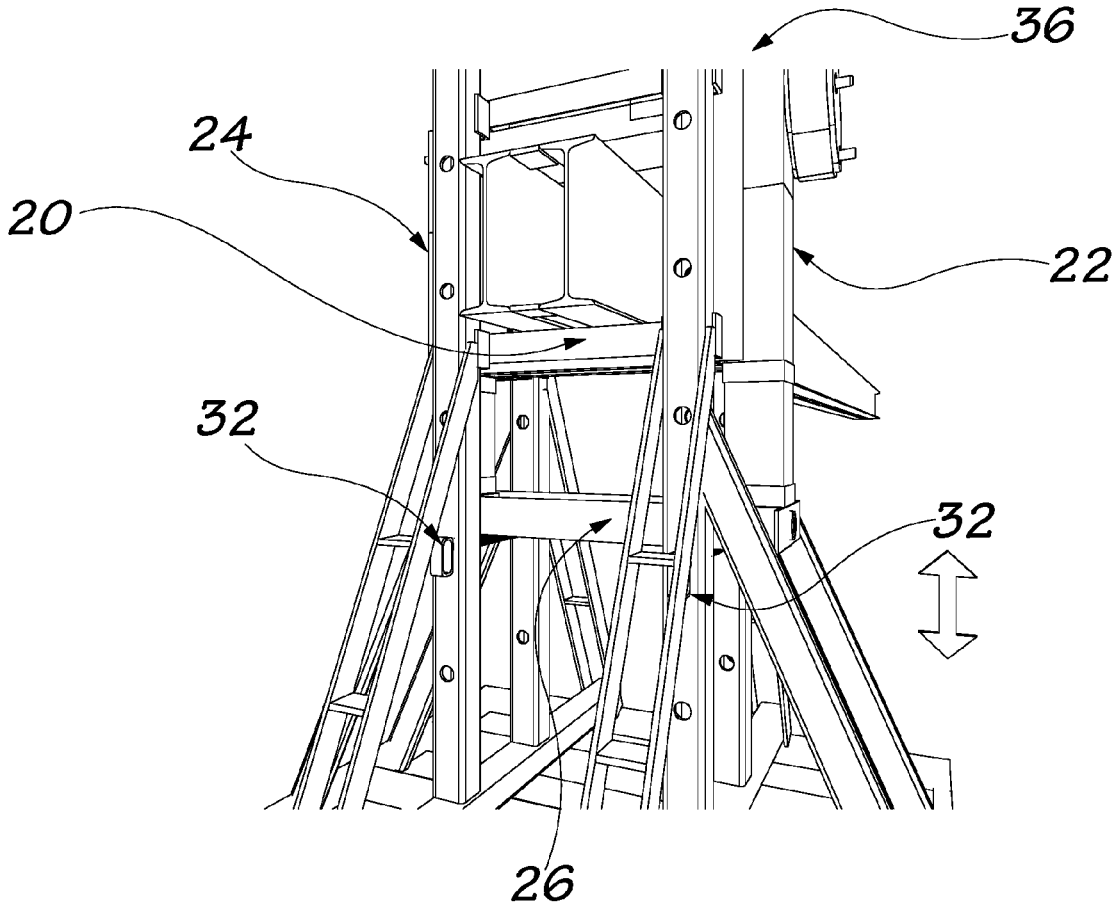

Turning now to FIGS. 3*a* through 3*z*, an exemplary method according to the present invention is illustrated. Although reference will be made to only a single tower or apparatus 10 as described in detail above, it will be clear from the above system description that implementation of methods according to the present invention would normally require multiple towers 10 to raise and lower a building.

The method begins with the apparatus 10 in a resting state (FIG. 3*a*), with the jack legs 22, 24, jack foot 26 and yolk 20 in their lowest possible position on the guide 12. The chain drive 36 is then actuated to extend the jack legs 22, 24 and jack foot 26, thereby causing the yolk 20 to rise (along with the secondary lifting beam 46 held in the yolk 20 aperture) as the jack foot 26 is pressed downwardly against the base 16 (FIG. 3*b*). The yolk 20 continues to rise relative to the base 16 and jack foot 26 (FIGS. 3*c* through 3*e*) until the holes 30 in the yolk 20 align with holes 28 in the masts 14 (FIG. 3*e*). At this stage (FIG. 3*f*), the chain drive 36 is halted with the yolk 20 disposed at the desired height with holes 28, 30 aligned.

With the chain drive 36 halted and the holes 28, 30 aligned, pins 32 are inserted through the holes 28, 30 (FIGS. 3*g* through 3*i*). The holes 28 extend fully through the masts 14, while the holes 30 extend fully through the yolk 20, such that the pins 32 can be inserted fully through the masts 14 and yolk 20 when the holes 28, 30 are aligned.

By locking the yolk 20 to the guide 12 through the insertion of the pins 32, the yolk 20 cannot move. This has the effect of allowing the chain drive 36 to move the jack foot 26 up towards the yoke 20. In FIG. 3*j* through 31, the chain drive 36 retracts the jack legs 22, 24, causing the jack foot 26 to rise upwardly until it becomes proximate to the yoke 20. The beam 46 has been stationary during the steps illustrated in FIG. 3*j* through 31, but now the jack foot 26 is in position to allow further upward movement of the beam 46.

Once the jack legs 22, 24 have attained full retraction (FIG. 3*m*), a set of pins 32 are inserted through the holes 28 in the masts 14 underneath the jack foot 26 and supporting it in place relative to the guide 12; note that these are a lower set of holes 28 than those locking the yoke 20 in place at this stage.

The upper set of pins 32 locking the yoke 20 in place are then removed (FIG. 3*n*), and the chain drive is actuated again to extend the jack legs 22, 24 (FIG. 3*o*). As the jack foot 26 has been locked into position by means of the lower set of pins 32, extension of the jack legs 22, 24 forces the yolk 20 and beam 46 upwardly again from the point at which they had been previously retained (FIG. 3*p*).

Once the jack legs 22, 24 are extended and the holes 30 align with an upper set of holes 28 on the masts 14, the yoke 20 can once again be locked using pins 32 (FIG. 3*q*), and the jack foot 26 can be raised by means of the chain drive retracting the jack legs 22, 24 (FIGS. 3*r* through 3*t*). The lower pins 32 had only been supporting the jack foot 26 and accordingly will not prevent it from moving upwardly. The lower pins 32 that had been supporting the jack foot 26 can be removed as soon as the upper pins 32 are inserted, or they can be left in position during these stages and removed before requiring reinsertion once the jack foot 26 reaches the new desired height and the chain drive 36 is halted (FIG. 3*u* through 3*w*).

With the lower pins 32 inserted beneath the jack foot 26, the upper set of pins 32 can be removed from the holes 28, 30 (FIG. 3*x*), and the chain drive 36 can once again extend the jack legs 22, 24 to drive the yolk 20 and beam 46 upwardly (FIGS. 3*y* to 3*z*).

As can readily be seen from the above, this series of alternating locking and moving of the jack mechanism and yolk 20 results in the secondary beam 46 being lifted vertically, thereby (as part of the exemplary system) lifting the primary beam 44 and the building supported by the primary beam 44. With the four towers 10 working together in this way, a building can be lifted to a desired height and maintained there for a desired period of time.

It will be clear that the act of lowering the beam 46 would be conducted in the reverse order of the above steps, with the yolk 20 beginning at the position shown in FIG. 3*z* and ending at the position shown in FIG. 3*a*. Upper locking pins 32 would hold the yolk 20 in place to allow the jack foot 26 to extend and therefore be lowered to a new jack foot 26 position, lower locking pins 32 would then be inserted beneath the jack foot 26, and the upper pins 32 could then be removed to allow the jack legs 22, 24 to retract and the yoke 20 and beam 46 to accordingly descend toward the jack foot 26, with this sequence repeating as necessary to allow the beam 46 to be lowered.

Figure 5A:
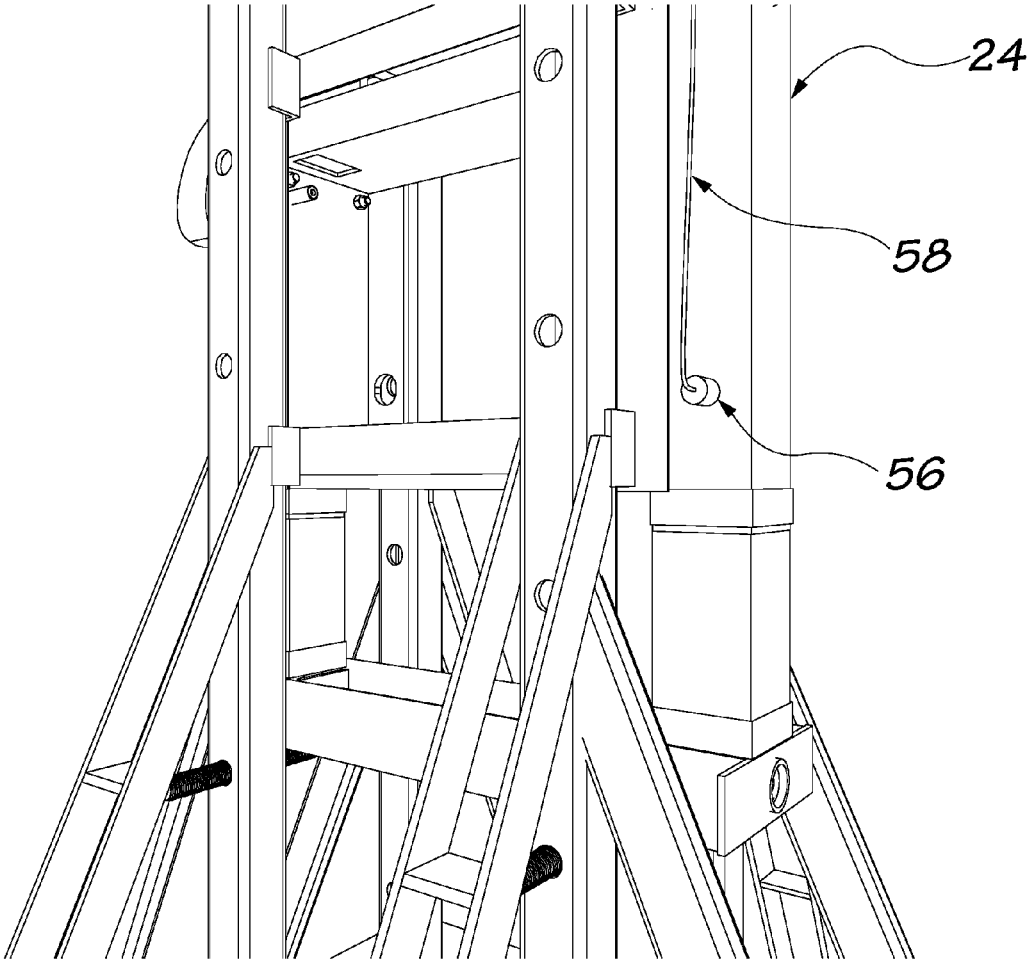
FIGS. 5*a* through 5*c* are detailed views of an automatic shut-off sensor and control box according to the present invention.
Figure 5B:
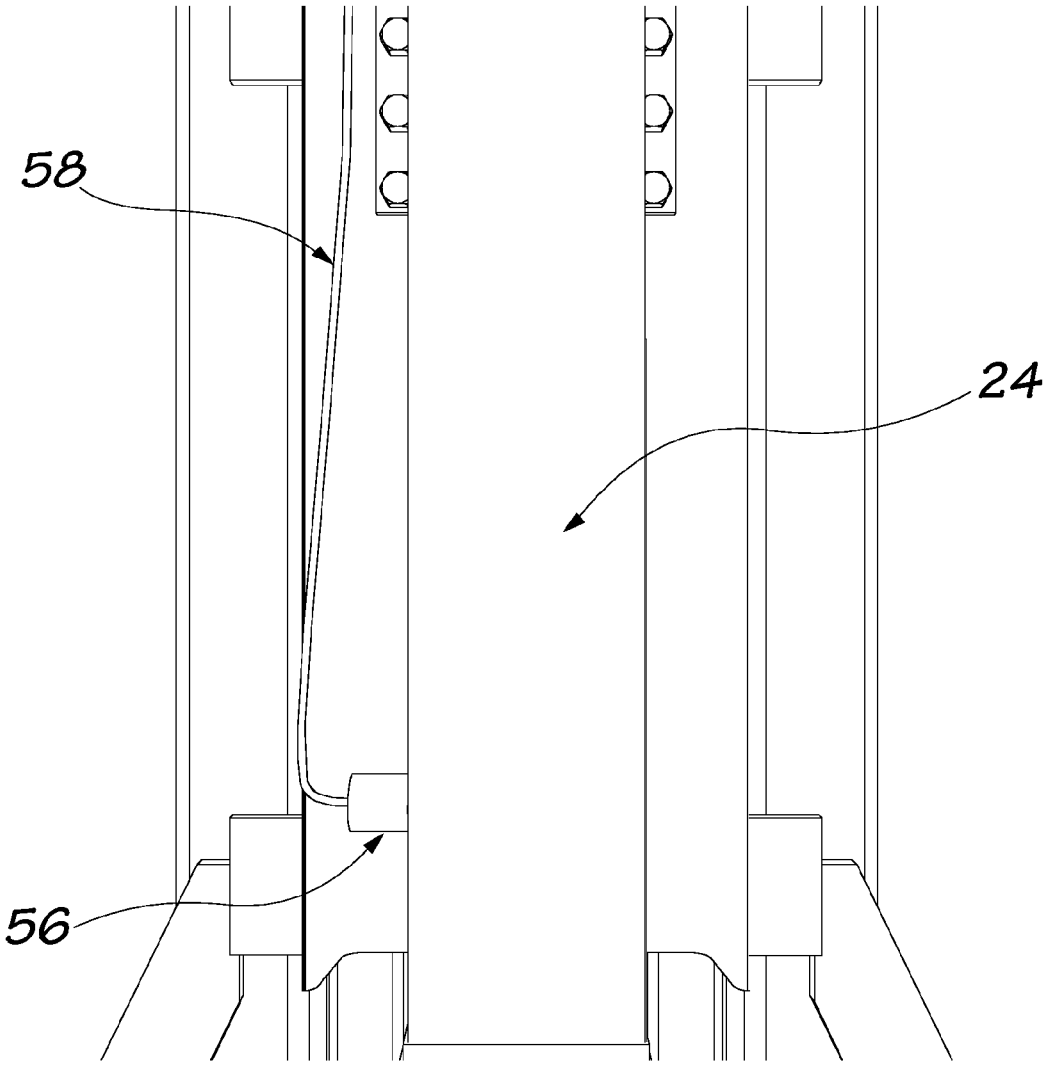
Figure 5C:
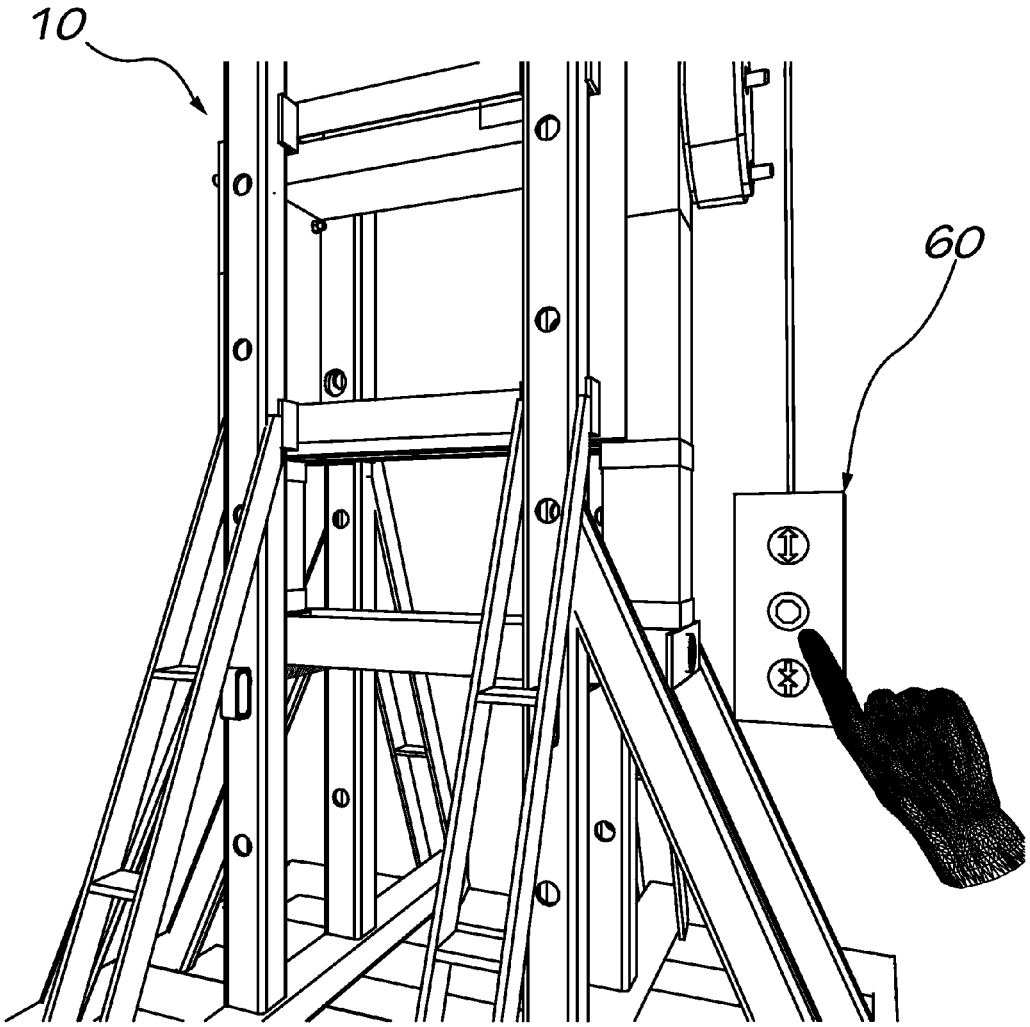
Figure 6A:
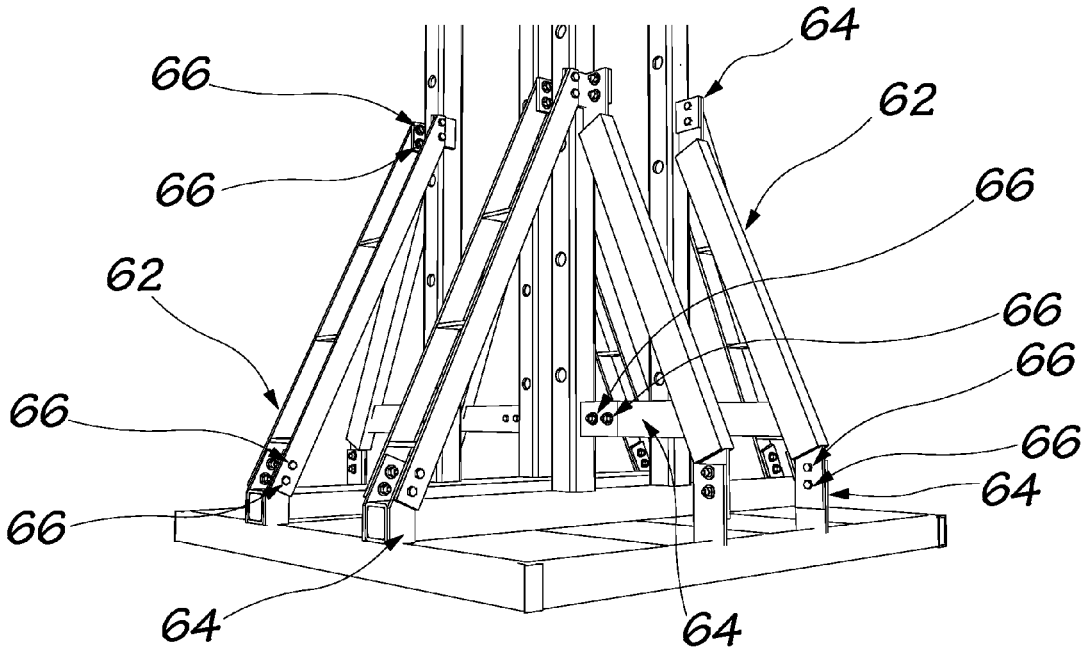
FIGS. 6*a* through 6*d* are detailed views of modular supports for an apparatus according to the present invention.
Figure 6B:
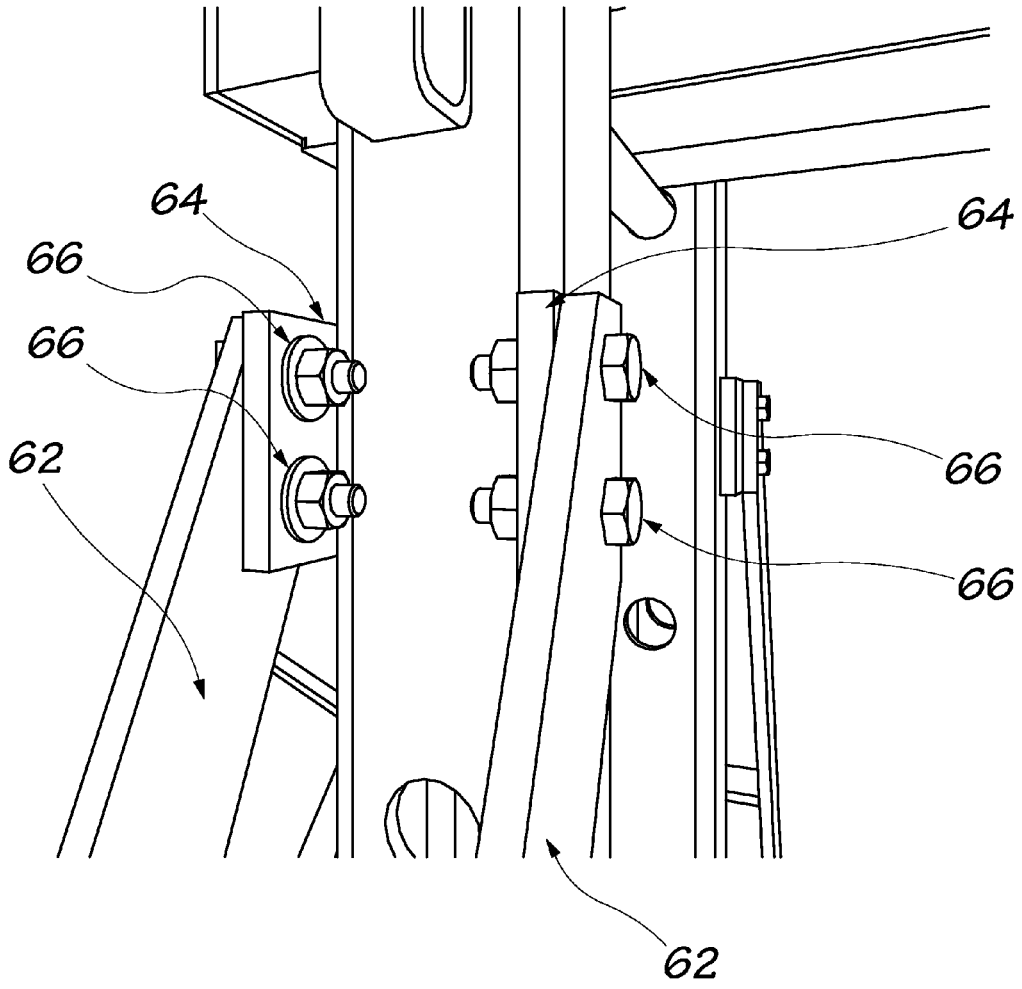
Figure 6C:
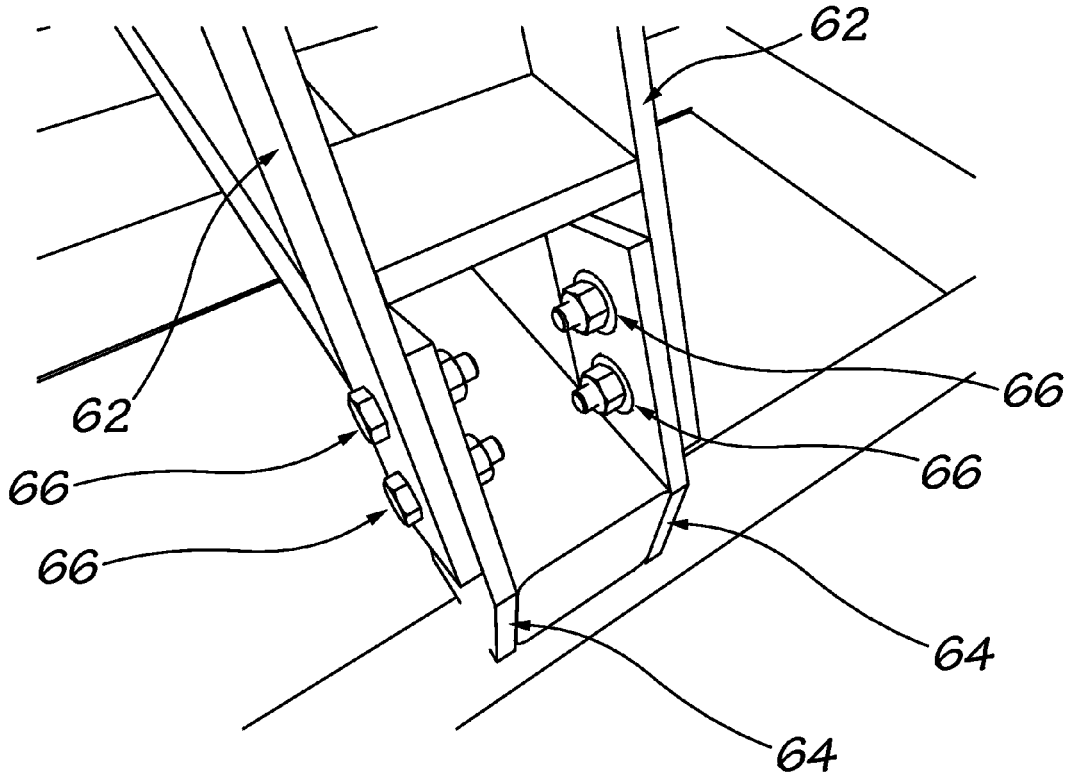
Figure 6D:
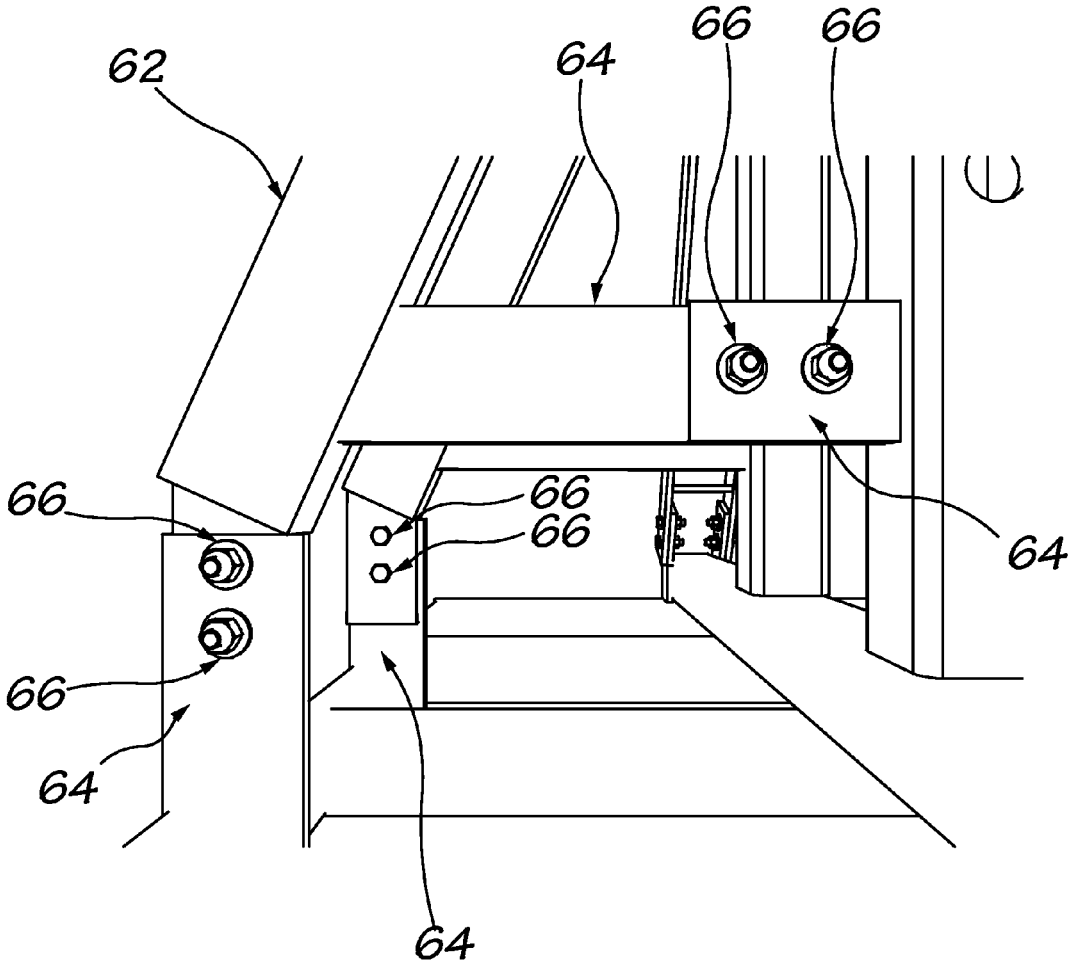

While it will be clear to those skilled in the art that the above-described apparatus, system and method can provide a more secure, stable lifting mechanism, modifications can be made to further reduce the time consumption and personnel requirements for operation. For example, FIGS. 5*a* and 5*b* illustrate a sensor 56 that can be positioned on a jack leg to enable automatic chain drive shut-down. In this embodiment, the jack leg comprises an inner and outer sleeve, the sensor 56 positioned on the outer sleeve and the inner sleeve provided with an upper hole and a lower hole corresponding to the full extension and retraction positions of the jack legs. As the jack legs are extended, the sensor 56 will eventually align with the lower hole and will sense a lack of metal, causing it to send a shut-down signal to the chain drive and resulting in the holes 28 and 30 aligning for pin 32 insertion to lock the yoke. As the jack legs are retracted, the sensor 56 will eventually align with the upper hole and will sense a lack of metal, causing it to again send a shut-down signal to the chain drive and resulting in the desired jack foot position for pin 32 insertion beneath the jack foot. As a further modification example, FIG. 5*c* illustrates a control box 60 which can be used by an operator to extend and retract the jack legs, which could be used to control one or more towers.

It will also be obvious that further automation of the system and method would be advantageous. For example, position sensors and electromechanical actuators could be used to enable automated pin insertion and removal, rather than the manual approach detailed above. Also, automation could be implemented to synchronize operation of the towers, with communication between the towers regarding yolk position and movement, which communication could involve a short range transmitter/receiver arrangement as would be known to those skilled in the art. Other advantageous modifications could include the incorporation of remote signal load sensors, laser integrated levelling systems, and closed circuit television monitoring, all of which are known technologies and could be implemented without undue experimentation.

Other advantageous potential modifications include modularization of tower components, to enable ease of storage and transportation. For example, FIGS. 6*a* through 6*d* illustrate the use of modular supports 62, which supports 62 are mounted in position by means of plates 64 and bolts 66. The other tower components could be modularized in like fashion to provide a collapsible structure that would be easier to transport to various job sites where building lifting is required.

The foregoing is considered as illustrative only of the principles of the invention. The scope of the claims should not be limited by the exemplary embodiment set forth in the foregoing, but should be given the broadest interpretation consistent with the specification as a whole.

The invention claimed is:

1. An apparatus for raising and lowering an end of a building lifting beam, the apparatus comprising:

a vertically oriented guide member;

a yolk member configured to be received on the guide member for vertical movement thereon, the yolk member configured to receive the end of the building lifting beam;

at least one selectively extendable and retractable jack on the yolk member for raising or lowering the yoke member to a desired yoke position on the guide member;

first locking means for releasably locking the yolk member in the desired yoke position on the guide member; and second locking means for releasably locking the at least one jack in a desired jack support position on the guide member;

such that when the first locking means are engaged and the second locking means are disengaged, the at least one jack can be moved to the desired jack support position; and when the first locking means are disengaged and the second locking means are engaged, the at least one jack can move the yoke member and the end of the building lifting beam to the desired yoke position, and wherein the first locking means comprise a releasable pin capable of receipt in a hole in the yoke member and a corresponding hole in the guide member when the holes are aligned, the guide member being provided with a plurality of holes for locking of the yoke member at various vertically spaced positions on the guide member.

2. The apparatus of claim 1 further comprising power means for powering extension and retraction of the at least one jack.

3. The apparatus of claim 2 wherein the second locking means comprise a releasable pin capable of receipt in a hole in the guide member for supporting the jack, the guide member being provided with a plurality of holes for locking of the jack at various vertically spaced positions on the guide member.

4. The apparatus of claim 3 further comprising hole position sensing means, wherein the releasable pin is automatically received in the hole upon the hole position sensing means sensing that a desired hole position has been reached.

5. The apparatus of claim 2 wherein the second locking means comprise a releasable pin capable of receipt in a hole in the guide member for supporting the jack, the guide member being provided with a plurality of holes for locking of the jack at various vertically spaced positions on the guide member, the apparatus further comprising automatic shut-off means for the power means, the automatic shut-off means comprising hole position sensing means for sensing that a desired hole position has been reached at which jack extension or retraction is to terminate.

6. The apparatus of claim 1 further comprising hole position sensing means, wherein the releasable pin is automatically received in the aligned holes upon the hole position sensing means sensing that a desired hole position has been reached.

7. The apparatus of claim 1 wherein the guide member is of modular construction to enable disassembly for ease of storage and transport.

8. The apparatus of claim 1 further comprising at least one vertical extension configured for receipt on top of the guide member, each of the at least one vertical extensions configured for receipt of the yolk member.

9. A system for raising and lowering a building, the system comprising:

a first pair of spaced apart vertically oriented guide members, each of the guide members for disposition on opposite sides of the building;

a second pair of spaced apart vertically oriented guide members, each of the guide members for disposition on opposite sides of the building;

a yolk member on each of the guide members, the yolk member configured for vertical movement thereon;

a first building lifting beam having opposed ends configured for receipt by the yolk members of the first pair of spaced apart vertically oriented guide members, the first building lifting beam configured for positioning beneath the building;

a second building lifting beam having opposed ends configured for receipt in the yolk members of the second pair of spaced apart vertically oriented guide members, the second building lifting beam configured for positioning beneath the building;

at least one selectively extendable and retractable jack on each yolk member for raising or lowering the yoke member to a desired yoke position on the guide member;

first locking means for releasably locking each yolk member in the desired yoke position on the guide member; and second locking means for releasably locking each jack in a desired jack support position on the guide member;

such that when the first locking means for each yolk member are engaged and the second locking means for each jack are disengaged, each jack can be moved to the desired jack support position; and when the first locking means for each yolk member are disengaged and the second locking means for each jack are engaged, each jack can move the yoke member and the end of the building lifting beam to the desired yoke position.

10. The system of claim 9 wherein the building lifting beams are of modular construction, the system further comprising extension sleeves for extending the length of the building lifting beams.

11. The system of claim 9 further comprising power means for powering extension and retraction of the jacks.

12. The system of claim 9 wherein the first locking means comprise a releasable pin capable of receipt in a hole in the yoke member and a corresponding hole in the guide member when the holes are aligned, the guide member being provided with a plurality of holes for locking of the yoke member at various vertically spaced positions on the guide member.

13. The system of claim 12 further comprising hole position sensing means, wherein the releasable pin is automatically received in the aligned holes upon the hole position sensing means sensing that a desired hole position has been reached.

14. The system of claim 9 wherein the second locking means comprise a releasable pin capable of receipt in a hole in the guide member for supporting the jack, the guide member being provided with a plurality of holes for locking of the jack at various vertically spaced positions on the guide member.

15. The system of claim 14 further comprising hole position sensing means, wherein the releasable pin is automatically received in the hole upon the hole position sensing means sensing that a desired hole position has been reached.

16. The system of claim 9 wherein the second locking means comprise a releasable pin capable of receipt in a hole in the guide member for supporting the jack, the guide member being provided with a plurality of holes for locking of the jack at various vertically spaced positions on the guide member, the system further comprising automatic shut-off means for the power means, the automatic shut-off means comprising hole position sensing means for sensing that a desired hole position has been reached at which jack extension or retraction is to terminate.

17. The system of claim 9 wherein each guide member is of modular construction to enable disassembly for ease of storage and transport.

18. The system of claim 9 further comprising at least one vertical extension configured for receipt on top of each guide member, each of the at least one vertical extensions configured for receipt of the yolk member.

19. A system for raising and lowering a building, the system comprising:

a first pair of spaced apart vertically oriented guide members;

a second pair of spaced apart vertically oriented guide members, the second pair of spaced apart vertically oriented guide members for disposition on an opposite side of the building from the first pair of spaced apart vertically oriented guide members;

a yolk member on each of the guide members, the yolk member configured for vertical movement thereon;

at least two primary lifting beams configured for positioning beneath the building, each of the primary lifting beams having opposed first and second ends;

a first secondary lifting beam having opposed ends configured for receipt by the yolk members of the first pair of spaced apart vertically oriented guide members, the first ends of the at least two primary lifting beams configured for connection to the first secondary lifting beam;

a second secondary lifting beam having opposed ends configured for receipt by the yolk members of the second pair of spaced apart vertically oriented guide members, the second ends of the at least two primary lifting beams configured for connection to the second secondary lifting beam;

at least one selectively extendable and retractable jack on each yolk member for raising or lowering the yoke member to a desired yoke position on the guide member;

first locking means for releasably locking each yolk member in the desired yoke position on the guide member; and second locking means for releasably locking each jack in a desired jack support position on the guide member;

such that when the first locking means for each yolk member are engaged and the second locking means for each jack are disengaged, each jack can be moved to the desired jack support position; and when the first locking means for each yolk member are disengaged and the second locking means for each jack are engaged, each jack can move the yoke member and the secondary lifting beam to the desired yoke position, thereby moving the primary lifting beam to raise or lower the building.

20. The system of claim 19 wherein the lifting beams are of modular construction, the system further comprising detachable primary beam sections for extending the length of the lifting beams.

21. The system of claim 19 further comprising power means for powering extension and retraction of the jacks.

22. The system of claim 19 wherein the first locking means comprise a releasable pin capable of receipt in a hole in the yoke member and a corresponding hole in the guide member when the holes are aligned, the guide member being provided with a plurality of holes for locking of the yoke member at various vertically spaced positions on the guide member.

23. The system of claim 22 further comprising hole position sensing means, wherein the releasable pin is automatically received in the aligned holes upon the hole position sensing means sensing that a desired hole position has been reached.

24. The system of claim 19 wherein the second locking means comprise a releasable pin capable of receipt in a hole in the guide member for supporting the jack, the guide member being provided with a plurality of holes for locking of the jack at various vertically spaced positions on the guide member.

25. The system of claim 24 further comprising hole position sensing means, wherein the releasable pin is automatically received in the hole upon the hole position sensing means sensing that a desired hole position has been reached.

26. The system of claim 19 wherein the second locking means comprise a releasable pin capable of receipt in a hole in the guide member for supporting the jack, the guide member being provided with a plurality of holes for locking of the jack at various vertically spaced positions on the guide member, the system further comprising automatic shut-off means for the power means, the automatic shut-off means comprising hole position sensing means for sensing that a desired hole position has been reached at which jack extension or retraction is to terminate.

27. The system of claim 19 wherein each guide member is of modular construction to enable disassembly for ease of storage and transport.

28. The system of claim 19 further comprising at least one vertical extension configured for receipt on top of each guide member, each of the at least one vertical extensions configured for receipt of the yolk member.

29. A method for raising a building, the method comprising the steps of:

a. providing at least two lifting beams and positioning them under the building;

b. providing a vertically oriented guide member for each end of each of the at least two lifting beams, each guide member comprising: a yolk member configured to be received on the guide member for vertical movement thereon, each yolk member comprising at least one selectively extendable and retractable jack; first locking means for releasably locking the yolk member in a position on the guide member; and second locking means for releasably locking the at least one jack in a position on the guide member;

c. receiving the ends of the lifting beams in the yoke members;

d. extending the jacks to force the yolk members upwardly, thereby raising the ends of the lifting beams;

e. engaging the first locking means;

f. retracting the jacks to raise the jacks;

g. engaging the second locking means to lock the jacks;

h. disengaging the first locking means; and i. extending the jacks to force the yolk members upwardly, thereby raising the ends of the lifting beams.

30. The method of claim 29 further comprising repeating steps e through i until the ends of the lifting beams are at a desired height relative to the guide members.

31. A method for raising and lowering a building, the method comprising the steps of:

a. providing at least two lifting beams and positioning them under the building;

b. providing a vertically oriented guide member for each end of each of the at least two lifting beams, each guide member comprising: a yolk member configured to be received on the guide member for vertical movement thereon, each yolk member comprising at least one selectively extendable and retractable jack; first locking means for releasably locking the yolk member in a position on the guide member; and second locking means for releasably locking the at least one jack in a position on the guide member;

c. receiving the ends of the lifting beams in the yoke members;

d. extending the jacks to force the yolk members upwardly, thereby raising the ends of the lifting beams;

e. engaging the first locking means;

f. retracting the jacks to raise the jacks;

g. engaging the second locking means to lock the jacks;

h. disengaging the first locking means;

i. extending the jacks to force the yolk members upwardly, thereby raising the ends of the lifting beams;

j. repeating steps e through i until the ends of the lifting beams are at an upper desired height relative to the guide members;

k. maintaining the ends of the lifting beams at the upper desired height for a desired period;

l. retracting the jacks to lower the yolk members, thereby lowering the ends of the lifting beams;

m. engaging the first locking means;

n. disengaging the second locking means;

o. extending the jacks to lower the jacks;

p. engaging the second locking means;

q. disengaging the first locking means;

r. retracting the jacks to lower the yolk members, thereby lowering the ends of the lifting beams; and s. repeating steps m through r until the ends of the lifting beams are at a lower desired height relative to the guide members.

* * * * *